US008774972B2

(12) United States Patent
Rusnak et al.

(10) Patent No.: US 8,774,972 B2
(45) Date of Patent: Jul. 8, 2014

(54) INTELLIGENT PUMP SYSTEM

(75) Inventors: Dennis M. Rusnak, Miamisburg, OH (US); Jason Ballard, Burlison, TN (US); Roger S. Turley, Springboro, OH (US)

(73) Assignee: Flowserve Management Company, Irving, TX (US)

( * ) Notice: Subject to any disclaimer, the term of this patent is extended or adjusted under 35 U.S.C. 154(b) by 754 days.

(21) Appl. No.: 11/748,126

(22) Filed: May 14, 2007

(65) Prior Publication Data

US 2008/0288115 A1 Nov. 20, 2008

(51) Int. Cl.
*G05D 7/00* (2006.01)
*F04D 15/00* (2006.01)

(52) U.S. Cl.
CPC ..... *F04D 15/0066* (2013.01)
USPC ..... 700/282; 415/122.1; 417/4; 700/281

(58) Field of Classification Search
CPC ..... F04D 15/0066; F04D 15/0236; F04D 15/0245; F04D 15/0254
USPC ..... 700/282; 415/122.1; 417/4
See application file for complete search history.

(56) References Cited

U.S. PATENT DOCUMENTS 4,108,574 A 8/1978 Bartley et al.
4,208,171 A 6/1980 Jonsson
4,678,248 A * 7/1987 Depenbrock ..... 318/805
5,240,380 A 8/1993 Mabe
5,267,441 A * 12/1993 Devier et al. ..... 60/452
5,589,076 A 12/1996 Womack
5,742,500 A * 4/1998 Irvin ..... 700/9
5,765,752 A 6/1998 Herr et al.
5,806,762 A 9/1998 Herr et al.
5,851,293 A 12/1998 Lane et al.
5,868,175 A * 2/1999 Duff et al. ..... 141/59
5,935,525 A 8/1999 Lincoln et al.
6,164,308 A 12/2000 Butler
6,178,393 B1 * 1/2001 Irvin ..... 703/10
6,210,105 B1 4/2001 Irish
6,260,004 B1 7/2001 Hays et al.
6,325,940 B1 12/2001 Ikeda
6,330,525 B1 12/2001 Hays et al.
6,350,105 B1 2/2002 Kobayashi et al.
6,354,318 B2 3/2002 Butler
6,372,127 B1 4/2002 Ikeda
6,457,950 B1 10/2002 Cooper et al.
6,463,740 B1 10/2002 Schmidt et al.

(Continued)

FOREIGN PATENT DOCUMENTS

JP 63138193 * 6/1988 ..... F04D 15/00

OTHER PUBLICATIONS

Escobar et al, "Analysis and Design of Direct Power Control . . .", 2003, pp. 1-8.*
Wikipedia, "Direct Torque Control", 1984, pp. 1-5.*

(Continued)

*Primary Examiner* — Ryan Jarrett
*Assistant Examiner* — Olvin Lopez Alvarez
(74) *Attorney, Agent, or Firm* — Dinsmore & Shohl LLP

(57) ABSTRACT

The present invention is a controller specifically for pumps, making the benefits of variable frequency drive (VFD) technology more accessible to pump users. The present invention incorporates pump-specific system optimization software, an industrial grade drive, and a menu-driven user interface, offering protection, reliability, and ease of use not possible with other variable frequency drives.

37 Claims, 12 Drawing Sheets

(56) References Cited

U.S. PATENT DOCUMENTS

| | | | | |
|---|---|---|---|---|
| 6,464,464 | B2 | 10/2002 | Sabini et al. | |
| 6,501,629 | B1 * | 12/2002 | Marriott | 361/22 |
| 6,506,310 | B2 | 1/2003 | Kulbeth | |
| 6,564,627 | B1 | 5/2003 | Sabini et al. | |
| 6,607,141 | B2 | 8/2003 | Paarporn | |
| 6,609,895 | B2 | 8/2003 | Forthuber et al. | |
| 6,625,027 | B2 | 9/2003 | Rider et al. | |
| 6,648,606 | B2 | 11/2003 | Sabini et al. | |
| 6,652,755 | B2 | 11/2003 | Ikeda | |
| 6,663,349 | B1 | 12/2003 | Discenzo et al. | |
| 6,691,536 | B2 | 2/2004 | Severns et al. | |
| 6,692,642 | B2 | 2/2004 | Josse et al. | |
| 6,709,241 | B2 | 3/2004 | Sabini et al. | |
| 6,715,996 | B2 | 4/2004 | Moeller | |
| 6,717,384 | B2 * | 4/2004 | Lin | 318/807 |
| 6,769,258 | B2 | 8/2004 | Pierson | |
| 6,771,032 | B2 * | 8/2004 | Cox-Smith et al. | 318/85 |
| 6,776,584 | B2 | 8/2004 | Sabini et al. | |
| 6,781,501 | B2 | 8/2004 | Layton | |
| 6,792,765 | B2 | 9/2004 | Domnick et al. | |
| 6,808,626 | B2 | 10/2004 | Kulbeth | |
| 6,830,842 | B2 | 12/2004 | Siepierski et al. | |
| 6,842,117 | B2 * | 1/2005 | Keown | 340/607 |
| 6,847,854 | B2 | 1/2005 | Discenzo | |
| 6,848,267 | B2 | 2/2005 | Pierson | |
| 6,898,951 | B2 | 5/2005 | Severns et al. | |
| 6,938,425 | B2 | 9/2005 | Simpson et al. | |
| 6,971,982 | B1 | 12/2005 | Kirsch | |
| 6,981,940 | B2 | 1/2006 | Rafferty | |
| 7,024,921 | B2 | 4/2006 | Sutton | |
| 7,036,559 | B2 | 5/2006 | Stanimirovic | |
| 7,050,873 | B1 | 5/2006 | Discenzo | |
| 7,080,508 | B2 | 7/2006 | Stavale et al. | |
| 7,112,037 | B2 | 9/2006 | Sabini et al. | |
| 7,117,120 | B2 | 10/2006 | Beck et al. | |
| 7,148,636 | B2 * | 12/2006 | Ueda et al. | 318/114 |
| 7,244,106 | B2 * | 7/2007 | Kallman et al. | 417/44.1 |
| 7,252,165 | B1 * | 8/2007 | Gruenwald et al. | 180/65.25 |
| 7,425,771 | B2 * | 9/2008 | Rivas et al. | 290/44 |
| 7,645,124 | B2 * | 1/2010 | Garlow | 417/44.2 |
| 2003/0138327 | A1 | 7/2003 | Jones et al. | |
| 2003/0154039 | A1 | 8/2003 | Moldovan | |
| 2004/0064292 | A1 | 4/2004 | Beck et al. | |
| 2005/0214127 | A1 * | 9/2005 | Scanderbeg et al. | 417/12 |
| 2006/0175064 | A1 * | 8/2006 | Yuratich | 166/381 |
| 2007/0212210 | A1 * | 9/2007 | Kernan et al. | 415/1 |
| 2007/0212229 | A1 * | 9/2007 | Stavale et al. | 417/42 |
| 2008/0040052 | A1 * | 2/2008 | Wago et al. | 702/34 |
| 2012/0020810 | A1 * | 1/2012 | Stiles et al. | 417/44.11 |

OTHER PUBLICATIONS

Larrinaga et al, "Predictive Control Strategy for DC/AC converters based on Direct Power Control", Jun. 2007, pp. 1-11.*
Lascu et al, "A Modified Direct torque Control for Induction Motor Sensorless Drive", 2000, pp. 1-9.*
Kennel et al , "A simple high performance and current control scheme for motor drives", 2005, pp. 1-6.*
Impeller net, "ACHEMA 2006", May 2006, pp. 1-3.*
FLowserve, "IPS tempo User Manual", Apr. 2006, pp. 308.*
Wikipedia, "publication date", Jul. 2011, pp. 3.*
Cox, Copyright Notice Vs. Publication Date, Jan. 7, 2008, Midwest Book Review, pp. 2.*
Flowserve, "Flowserve Introduces IPS Tempo Intelligent Pump Soultion", Feb. 21, 2006, pp. 2.*
College of New York, "Centrifugal Pump Selection, Sizing, and interpretation of Performance Curves", Oct. 12, 2003, http://www-ce.engr.ccny.cuny.edu/Courses/CE365/Pump_selection.pdf, pp. 7.*
Flowserve, "IPS Tempo™ Pre-engineered Pump System Optimization, Control and Protection", Mar. 15, 2006, Flexachem http://flexachem1.com/catalog/pub/IPS%20TEMPO.pdf, pp. 8.*
Google, "search tools and filters", Mar. 15, 2013, pp. 3.*
Flowserve, "Pump Power Monitor Model Kw941", Apr. 15, 2004, http://flexachem1.com/catalog/pub/Power%20monitor.pdf, pp. 2.*
Flowserve, "Flowserve KW941 Pump Power MonitorTM", 2005, pp. 1-28.*
Drive IT Low Voltage AC Drives, ACS550 User's Manual, 2004 ABB Inc.
FoamPro SuperCharges, Brochure, Aug. 2004, Printed in USA.
Allen-Bradley Bulletin 1336 Plus Process PI Regulator, Application Note #1336S-16, Jul. 1, 1997.
VFD Recommendations (Variable Frequency Drive), ITT Industries, pdf created Jun. 13, 2000.
ABB Standard drives (ACS550, 0.75 to 355 kW/1 to 500 hp) Technical Catalogue, Jul. 2, 2006.
The Pump Guy, Beware the Affinity Police, pdf created Apr. 7, 2005.
Goulds Pumps, G&L Series Commerical Products, ITT Industries, Jun. 2006.
Goulds Pumps, G&L Series Aquavar, ITT Industries, Feb. 2005.
Rockwell Automation Introduces New Reliance Electric GV6000 AC Drive, pdf created Feb. 4, 2005.
Reliance Electric GV6000 Drive from Rockwell Automation Offers Easy to Use and Versatile Solution for Drive Applications, press release, Apr. 26, 2005. www.reliance.com/news/press_releases.
GV6000 AC Drive User Manual, Instruction Manual D2-3540, Rockwell Automation, 2005.
Guardian Variable Speed Drive, The Digital Solution for Productino Control, R&M Energy Systems, printed in USA, 2005.
Aquavar CPC Installation and Operation Manual, Goulds Pumps, ITT Industries, Jul. 2004.

* cited by examiner

INTELLIGENT PUMP SYSTEM

FIELD OF THE INVENTION

The present invention relates generally to pump controllers, and more particularly to a variable frequency drive based controller for controlling a centrifugal pump within safety parameters by using intelligent pump system monitors.

BACKGROUND OF THE INVENTION

Variable frequency drives (VFD) are used to adjust motor speed of the pump by controlling the frequency of the electrical power supplied to the motor so as to regulate flow within a pump system. It is known in the prior art to use of a VFD and an external processor to control a centrifugal pump. The VFD is used to vary pump speed and provide speed and torque measurements. Typically, prior art VFD techniques require at least one external sensor (differential pressure, discharge pressure, or flow sensor) and use pump Affinity Laws to characterize (develop performance curve) normal pump performance at a number of different operating points. These expected normal values determined from the pump characterization process are stored in the processor's memory. Then, during pump operation, performance is again determined using the above method and compared by the processor to the corresponding stored "normal" values to determine if pump operation has become degraded.

In other prior art pump control methods, relationships (curves) are developed between TDH and Torque for minimum and maximum allowable flow points over a variety of speeds and used to identify the operating point of the pump and determine if it is operating within an allowable minimum and maximum flow range. Pump performance curves, relationships between BHP, flow and TDH, and between BHP, torque and speed, as well the Affinity laws are used to develop the TDH vs. torque curves. Motor torque and speed values from a VFD are supplied to a processor where TDH, torque and speed relationships are used in a processor to identify the operating point of the pump and determine if the pump is operating within the allowable minimum and maximum allowable flow ranges. This method has been deployed in a VFD.

Although the above prior art methods are adequate for their intended purposes, it would be useful to have a pump controller that neither requires an external sensor, nor does it require performance values calculated at multiple speeds to be stored in memory. Also, it would be useful to have a controller that does not require generation of any unique performance curves, i.e. TDH vs. Torque. Such features would simplify the set-up and operation of a VFD controller for a centrifugal pump.

SUMMARY OF THE INVENTION

A method of controlling operation of a centrifugal pump in a fluid pumping system having a variable frequency drive powering an alternating current (AC) motor which turns said centrifugal pump is disclosed. The method comprises internally monitoring automatically output current and voltage of the VFD to the AC motor without the need for an external sensor; calculating automatically output power based on monitored values of said output current and voltage; checking automatically whether said calculated output power is either above a predetermined high power limit or below a predetermined low power limit for a desired setpoint; and initiating automatically a predetermined response action if said calculated output power is either above said predetermined high power limit or below said predetermined low power limit.

A controller implementing the above method is also disclosed.

Other advantages of the system of the present invention will be apparent from the following detailed description. The invention is described in more detail hereinafter with reference to the accompanying drawings.

DETAILED DESCRIPTION

Figure 1:
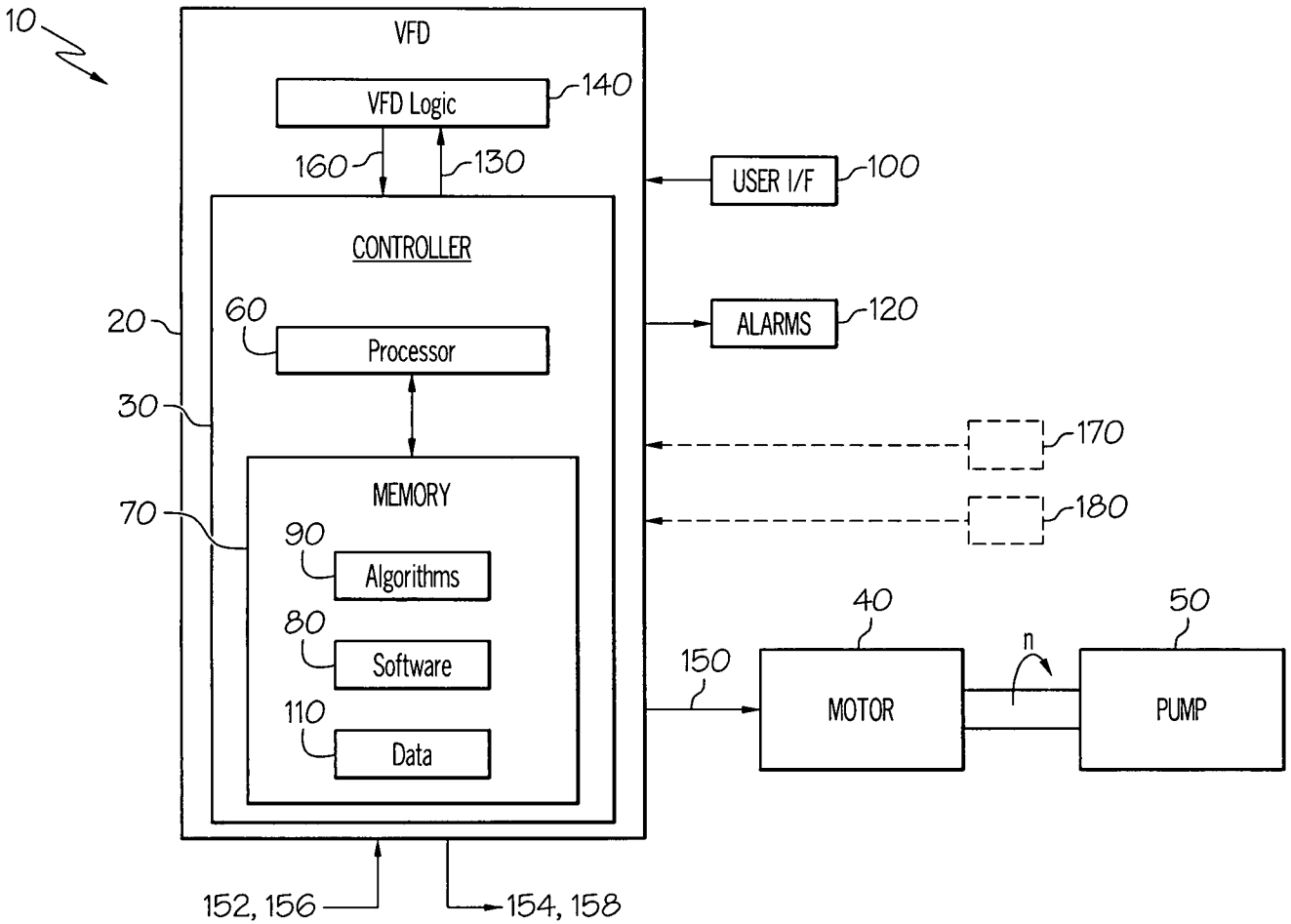
FIG. 1 is a block diagram of a pumping system with a controller for controlling the pumping system according to the present invention.

Referring to FIG. 1, there is shown a pumping system 10 having a variable frequency drive (VFD) 20 with a controller 30 for controlling the pumping system according to the present invention. The VFD 20 is coupled to an AC motor 40 which turns a centrifugal pump 50 at a rotational speed (n). The controller 30 operates the VFD 20 to control flow, speed or pressure of the pumping system 10, and to identify and report pump system problems. As shown, the controller 30 includes a processor 60 connected to memory 70 which contains executable software 80 and algorithms 90 for controlling the motor and pump according to the present invention.

It is to be noted that, as used herein, the term "variable frequency drive" is to include adjustable frequency drives (AFDs), Variable Speed Controllers (VSCs), Variable-speed Drives (VSD), AC drives or inverter drives, Variable Voltage Variable Frequency drives (VVVF), or something similar, which operates to control motor speed. It is to be further noted that although the controller 30 of the present invention is shown embedded within the VFD 20, in other embodiments the controller 30 may be externally connected between the VFD 20 and the motor 40 of pumping system 10. The latter implementation permits use of the controller 30 with virtually any type of VFD devices. It is still other embodiments, VFDs having an embedded controller, or vice verse, may be modified with at least the executable software 80 to control the motor 40 and pump 50 according to the present invention. One suitable VFD 20 having an embedded controller 30 in which to modified with at least the executable software 80 of present invention is the New Reliance Electric™ GV6000 AC Drive from Rockwell Automation, Inc. (Milwaukee, Wis.).

The processor 60 may be a large scale integrated (LSI), VLSI, or better integrated circuit controlled by software programs allowing operation of arithmetic calculations, logic and I/O operations. Other processors, including application-specific integrated circuit (ASIC), System-on-a-chip (SoC), and digital signal processors (DSPs) are also contemplated. Memory 70 such as a random access memory, (RAM), flash memory, or other addressable memory is included within the controller 30 for storing data values as well as pump set-up parameters and operating conditions. As will be explained hereafter in greater details, the processor 60 performs processing according to the present invention by activating the executable software 80 which responds to user inputs via a user interface 100, as well as to data 110 and the algorithms 90 to perform a myriad of arithmetic calculations for comparison with operating values. Based on the results of those calculations and the comparison with operating values, the software 80 functions to generate an alarm signal 120 indicative of an alarm condition associated with a particular operating parameter(s), and/or generates a signal which alters the current motor speed (n) to correct for an abnormal operating condition when the difference between the calculated and stored parameter values in the data 110 exceed a predetermined numeric value.

The controller 30 operates to generate a control signal 130 to VFD logic 140 within the VFD 20 indicative of a request to reduce or increase motor speed (n) in order to correct for detected abnormal condition. The VFD 20 then generates a signal 150 to the motor 40 corresponding to a change in voltage and/or frequency to cause the motor speed (n) to change in an amount proportional to the controller generated control signal 130. The software 80 of the present invention will now be explained in greater details with refer made also to FIG. 2.

Basic Start-Up Flow Description

Figure 2:
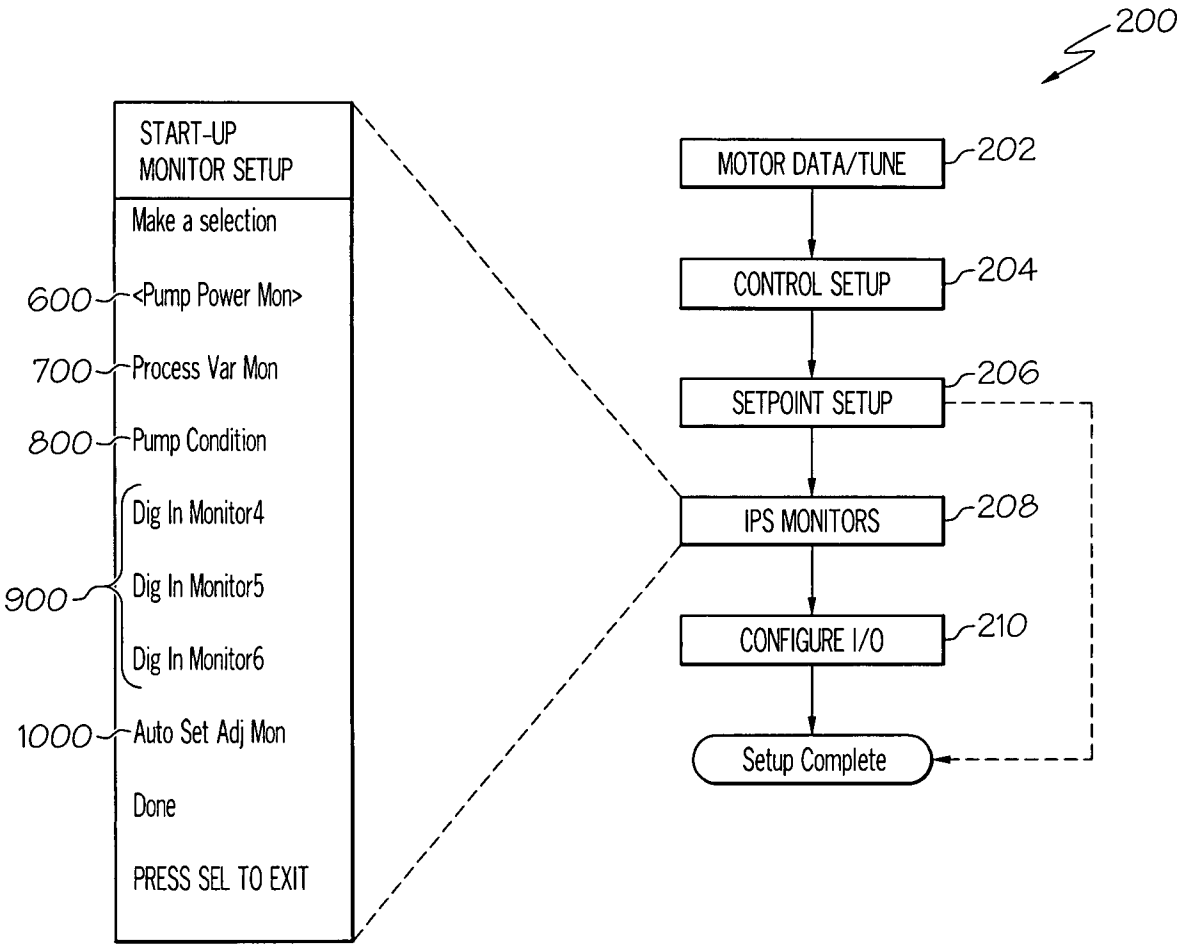
FIG. 2 is an exemplary illustration of pump data required for program calculations of the controller according to the present invention.

FIG. 2 is a flow chart depicting the basic start flow 200 provided by the software 80 to set-up the controller 30 according to the present invention. As shown, in step 202, motor data/tune information is entered via the user interface 100 and stored as data 110 in the controller 30. In this step, the user inputs the nameplate motor data, start/stop methods, performs a rotational check, and auto tunes the controller 30. This is explained in greater details in a later section with reference to FIG. 3. In step 204, control setup information is entered via the user interface 100 and stored as data 110 in the controller 30. In this step, the user inputs the type of control used by the controller 30, either speed mode or process mode.

It is to be noted that the software 80 of the present invention operates the controller 30 in either a speed or process mode. In the speed mode, the controller 30 maintains a specific motor speed (n) entered by the user, i.e. the setpoint, and operates in either open loop, i.e. no speed feedback or in closed loop with speed feedback 160. Without speed feedback the controller 30 puts out a constant frequency but the actual speed of the motor/pump can vary due to motor slippage caused by load. With speed feedback 160, the controller 30 operates in closed loop control and will continuously adjust the output frequency of the VFD 20, i.e., signal 150, to maintain the setpoint speed. It is to be appreciated that the controller 30 also include a number of other analog inputs 152 and analog outputs 154 as well as the a number of digital inputs 156 and digital outputs 158 for more specific needs, which are discussed in later sections. As input, the speed feedback 160 can come from either an optional external sensor 170, e.g., a tachometer, or an internal speed feedback parameter that is an estimate of true speed calculated by the variable frequency drive (VFD) using the VFD manufacturer's algorithms provided with the VFD. By default, the controller 30 is set to use internal feedback in the speed mode, i.e., "Sensorless Vector" control.

In the process control mode, the controller 30 uses the input from an optional external process sensor(s) 180 as feedback and will continuously adjust speed to maintain the process variable setpoint(s). The process sensor(s) 180 can be any typical sensor such as pressure, flowmeter, temperature, etc. Note that flow measurements may be obtained using conventional flow measuring devices such as ventures, orifice plates, mag meters and the like. With the user interface 100, the user can enter the process setpoint directly in the data 110 of the controller 30 indicated in the desired units (i.e., gpm, psi, degrees, ft of head, etc.). The controller 30 will then continuously adjust speed to maintain the desired process setpoint.

If the user selects speed mode in step 204, the software 80 proceeds to step 206, the setpoint setup. If the user selects process mode in step 204, the software 80 via the user interface 100 prompts the user to set up the process type and scale the feedback sensor before proceeding to step 206 for entering the setpoint setup information. This is explained in greater details in a later section with reference to FIG. 4. In step 206, the user will setup the reference source and setpoint for the selected control (Speed or Process) mode entered in step 204. This is explained in greater details in a later section with reference to FIG. 5A (Setpoint for Process Mode) and FIG. 5B (Setpoint for Speed Mode).

In step 208, intelligent pump system (IPS) monitor setup information is entered via the user interface 100 and stored as data 110 in the controller 30. The available IPS monitors are Pump Power Monitor (PPM), Process Variable Monitor (PVM), Pump Condition Monitor (PCM), Digital Input Monitors (DIM), and the Automatic Setpoint Adjustment Monitor (ASAM). Each of the IPS monitors is explained in greater details in later sections with reference to FIGS. 6-10.

In step 210, the user enters information via the user interface 100 to configure the input/output signals and stored as data in the controller 30. In particular, in this step, the user may configure analog inputs 152 and analog outputs 154 as well as the digital inputs 156 and digital outputs 158 for more specific needs. At this point, the basic start flow 200 provided by the software 80 to set-up the controller 30 according to the present invention is now finished, and the controller 30 is now ready to operate with the use of the IPS monitors. However, it is to be appreciated that the controller 30 is ready for operation after step 206 without enabling the IPS monitors, if such is a desire.

Motor Data/Tune

Figure 3:
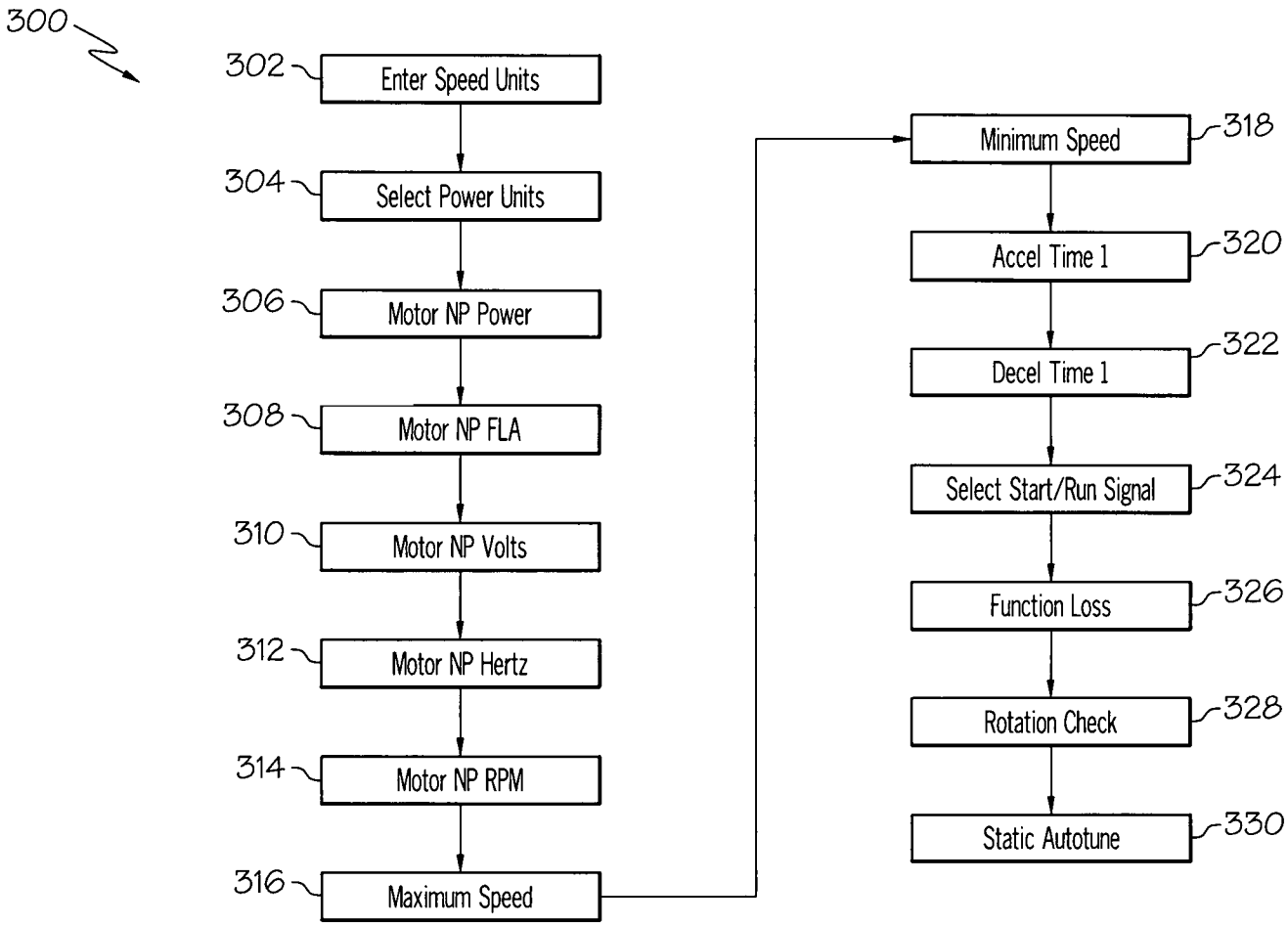
FIG. 3 is a flow chart depicting motor data/tune set up of the controller according to the present invention.

Reference now is made to FIG. 3, which is a flowchart showing in greater detail the motor data/tune information 300 requested by the software 80 and entered into data 110 of the controller 30 by the user via the user interface 100 in step 202 (FIG. 2) to set-up the controller 30 according to the present invention. In step 302, the user may enter the speed units that the user interface 100 will display, either in revolutions per minute (RPM) or hertz (Hz). The default is RPM. In step 304, the user may enter the units from which the controller 30 will reference power, either horsepower (HP) or kilowatts (kW). The default is HP. In step 306, the user enters the power rating found on the motor name plate (NP Power). In step 308, the user enters the full load amp rating found on the motor nameplate (NP FLA). In step 310, the user enters the voltage rating found on the motor nameplate (NP VOLTS). In step 312, the user enters the frequency found on the motor nameplate (NP HERTZ). In step 314, the user enters the rpm found on the motor nameplate (NP RPM). In step 316, the user enters the maximum speed the pump needs to run (MAXIMUM SPEED). This will be used as a reference for the process variable monitor (PVM).

In step 318, the user enters the minimum speed the pump should run (MINIMUM SPEED). This will be used as a reference for the process variable monitor (PVM). In step 320, the user enters the desired time for the controller 30 to give the motor 40 to reach the process setpoint after a start or speed increase command (ACCELERATION TIME). In step 322, the user enters the rate of deceleration for all speed decreases (DECELERATION TIME). In step 324, the user selects the signal source which commands the controller 30 to start and stop (START/RUN SIGNAL SOURCE). In step 326, the user selects "Yes" to configure a digital input for a function loss (FUNCTION LOSS) of the START/RUN SIGNAL SOURCE. If configured for a function loss, the controller 30 will not operate when the digital input is open. In step 328, the user selects to verify that the direction of pump rotation is correct (ROTATION CHECK). If the pump's rotation is incorrect, the user selects "No" and the controller 30 will correct the rotation. In step 330, the user selects to initiate a non-rotational motor stator resistance test for autotuning which gives the controller 30 the best possible motor control (STATIC AUTOTUNE).

Control Mode

Figure 4:
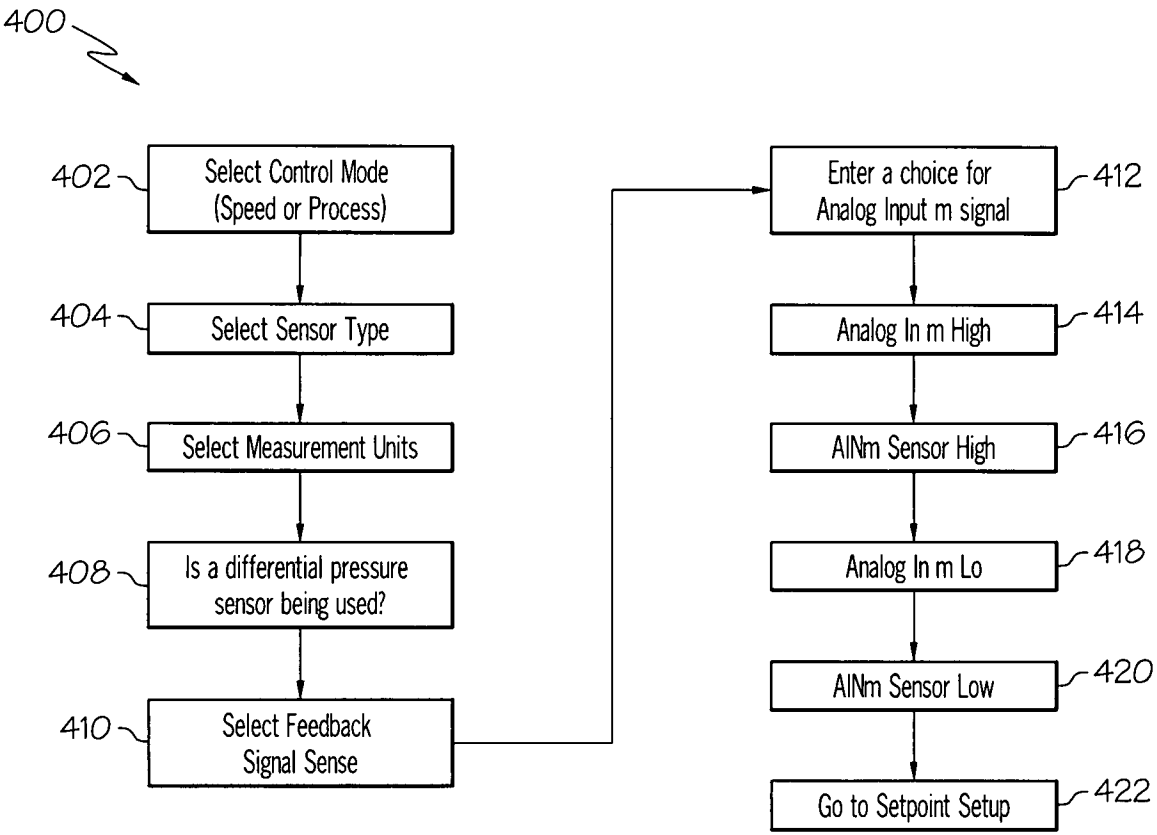
FIG. 4 is a flow chart depicting control mode set up of the controller according to the present invention.

Reference now is made to FIG. 4, which shows in greater detail the control mode information 400 requested by the software 80 and entered into data 110 of the controller 30 by the user via the user interface 100 in step 204 (FIG. 2). In step 402, the user selects the mode of operation, either Speed Mode or Process Mode (CONTROL MODE). In step 404, the user selects the type of sensor used to control the process (Flow, Temperature, Pressure, Level, or Other)(SENSOR TYPE). This sensor is connected to an analog input designated herein as Analog Input m. In step 406, the user selects the desired units of measure for the process (UNITS). In step 408, the user selects whether to use a differential pressure sensor to measure the flow (DIFFERENTIAL PRESSURE SENSOR). The default is no, and is an optional step in the setup of the controller 30. In step 410, the user selects the feedback signal sense (FEEDBACK SIGNAL SENSE). The user selects "Normal" if the process condition will increase with pump speed. The user selects "Inverse" if the process condition will decrease with pump speed. The default is normal, and is an optional step in the start-up of the controller 30.

In step 412, the user selects the type of analog input signal (ANALOG INPUT m SIGNAL). The user selects "Current" to use a current sensor, or select "Voltage" to use a voltage sensor. The default is current. In step 414, the user enters the maximum analog input signal of Analog Input m (e.g. 20 mA or 10 VDC)(ANALOG IN m HIGH). In step 416, the user enters the process value that corresponds to the maximum analog input signal of Analog Input m (e.g. 300 psi=20 mA) (AINm SENSOR HIGH). In step 418, the user enters the minimum input signal of Analog Input m (e.g. 4 mA or 2 VDC)(ANALOG IN m LO). In step 420, the user enters the process value that corresponds to the minimum input signal of Analog Input m (e.g. 0 psi=4 mA)(AINm SENSOR LOW). In step 422, the user then goes to the setpoint setup in step 206 (FIG. 2), which is explained hereafter in greater details.

Setpoint for Process Mode

Figure 5A:
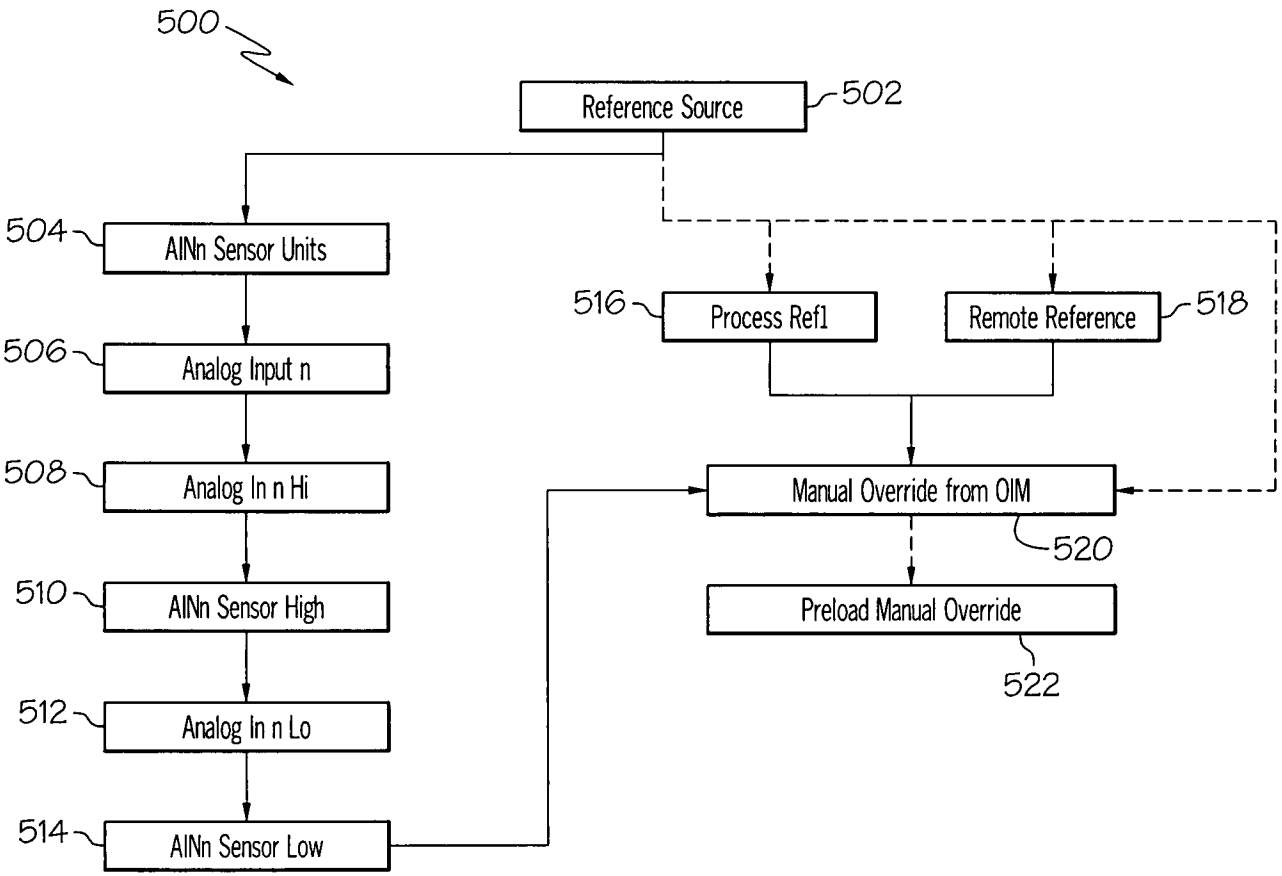
FIG. 5A is a flow chart depicting a reference source set up associated with process control mode of the controller.

Reference now is made to FIG. 5A, which shows in greater detail the process mode setpoint information 500 requested by the software 80 and entered into data 110 of the controller 30 by the user via the user interface 100 if selected in step 206 (FIG. 2). In step 502, the user selects from where the process setpoint is referenced (REFERENCE SOURCE). The choices available are the user interface 100, a process reference (e.g., sensor 180), a remote reference (e.g., one of the digital inputs 156 providing input from a connected network source), and a sensor connected to an analog input 152 designated herein as Analog Input n. In the follow example, Analog Input n is selected. In step 504, the user then enters the units of measure for the sensor connected to Analog Input n (AINn SENSOR UNITS). In step 506, the user selects "Current" if the sensor connected to Analog Input n is a current sensor, or "Voltage" if the sensor connect to Analog Input n is a voltage sensor (ANALOG INPUT n). In step 508, the user enters the maximum input signal of the sensor connect to Analog Input n (e.g. 20 mA or 10 VDC)(ANALOG IN n HI). In step 510, the user enters the process value that corresponds to the maximum input signal of the sensor connected to Analog Input n (e.g. 300 psi=20 mA)(AINn SENSOR HIGH). In step 512, the user enters the minimum input signal of the sensor connected to Analog Input n (e.g. 4 mA or 2 VDC) (ANALOG IN n LO). In step 514, the user enters the process value that corresponds to the minimum input signal of the sensor connected to Analog Input n (e.g. 0 psi=4 mA)(AINn SENSOR LOW).

Had the user selected either the user interface 100, the process reference (e.g., sensor 180, or one of the inputs 152), or the remote reference (e.g., one of the digital inputs 156) in step 502, steps 504-514 would have been skipped by the software 80. If the user selects process reference, then in step 516 the user is prompted by the software 80 to enter the value for process reference (PROCESS REF1). This value PROCESS REF1 is then the process setpoint value for controller 30. If the user selects remote reference, then in step 518 the user selects the interface connection (e.g. port number, network address, etc.) of the remote reference providing the process setpoint value (REMOTE REFERENCE). After step 514, 516, or 518, the user is then prompted by the software 80 in step 520 to set the availability of manual override control from the user interface 100 (MANUAL OVERRIDE FROM OIM). Manual override mode is used to disable the control algorithm of the controller 30 and operate the pump in speed mode. Either the Auto/Manual button on the user interface 100 or digital inputs, if so configured, can activate the manual override mode. Once the manual override mode has been activated, it can only be deactivated by the source that enabled it. Manual override can be configured to work one of two ways, depending on the setting of the controller 30. Either all of the IPS monitors will be disabled when manual override is activated, or all of the IPS monitors that were enabled prior to Manual Override will default to "Message Only," except for those that are set to "Shut Down." Once Manual Override mode has been disabled, the system returns to its original state, and all timers and alarms are reset.

In step 520, the user select "Yes" to enable the manual override functionality (i.e., Auto/Manual button) on the user interface 100, or "No" to disable this functionality. Next, if the user had selected "Yes" in step 520, then in step 522, the user is requested to select which speed reference is to be used on manual override (PRELOAD MANUAL OVERRIDE). If the user selects "Yes" then when the Auto/Manual button on the user interface 100 is activated, the software will load the current operating speed as the reference speed. If the user selects "No" then software will load the speed reference being entered manually by the user via the user interface when manual override is activated. If one of the digital inputs 156 is used to activate manual override mode while the system is running in process mode or speed mode, then the reference speed is determined by the preselected digital input. As mentioned above, after entering the above setpoint information, the controller 30 is ready to run with no pump protection from the IPS monitors, if such is a desire.

It is to be appreciated that in process control mode the present invention does not compare the actual operating point of the centrifugal pump (based on motor torque and motor speed) to minimum and maximum flow operating ranges. Rather the present invention in process control (PI) mode compares the controlled process variable (i.e., psi, flow, etc.) to a desired set point, and adjusts speed to maintain the desired set point. If the required set point for the controlled process variable cannot be attained within the present invention's preset maximum and minimum speed limits, a response action will be initiated. In addition, power at each speed may be compared to minimum and maximum power limits to determine whether the centrifugal pump is operating within its power limits.

An internal proportional integral control algorithms (PI regulator) is provided to manage the speed output response of the present invention to a change in a process setpoint or a change in the controlled variable. There are two ways the PI regulator can be configured to operate: Process trim, which takes the output of the PI regulator and sums it with a master speed reference to control the process; and Process control, which takes the output of the PI regulator as the speed command. No master speed reference exists, and the PI output directly controls the present invention output.

The user is able to input two P and I variables. Process I-time (a value between 0.00-100.00 sec) specifies the time required for the integral component to reach 100% of the process error (i.e., feedback). Process P-Gain (a value between 0.00-100.00) sets the value for the process regulator proportional component and is used in the following equation: Process Err Out×Process P-Gain=Process Output. However, the Process P-Gain should not be considered a stability factor which prevents overcorrecting and instability. Generally, although proportional control can reduce error substantially, it cannot by itself reduce the error to zero (i.e., instability will remain). The error can, however, is reduced to zero by adding the integral term (Process I-time) to the control function. The PI integrator in a closed loop seeks to hold its average input at zero, but it does not "prevent" overcorrecting as oscillation about the setpoint (above and below) can occur when correcting the average input to zero.

Internal sensors of the VFD are provided to monitor the output frequency and amperes, and also to store in memory the nameplate motor frequency. However, the present invention does not utilize this information in the software 80 to automatically maintain a desired flow rate ratio as mentioned above. In sharp contrast, the present invention in process variable monitor (PVM), as explained hereafter in a later section, monitors the speed required to maintain a required process setpoint (i.e., a desired flow rate) detected by a flow rate meter, and to detect a process no longer controllable within set operating speed limits and automatically initiate a user selected response action. In pump power monitor (PPM), which is also explained hereafter in a later section, in either process control mode or speed control mode, internally monitors current and voltage, and calculates VFD output power and check to see that its not above or below predetermined normal limits for a desired setpoint. Accordingly, no current reading (i.e., current value) is used in a programmed relationship between current, frequency, and flow rate, thereby making the system much easier to setup and operate.

The process control mode allows the present invention to take a reference signal (setpoint) and an actual signal (feedback) and automatically adjust the speed to match the actual signal to the reference. Proportional control (P) adjusts the output based on the size of the error (larger error=proportionally larger correction). Integral control (I) adjusts the output based on the duration of the error. The integral control by itself is a ramp output correction. This type of control gives a smoothing effect to the output and will continue to integrate until zero error is achieved. By itself, integral control is slower than many applications require, and, therefore, is combined with proportional control (PI). The purpose of the PI regulator is to regulate a process variable such as position, pressure, temperature, or flow rate, by controlling speed.

Setpoint for Speed Mode

Figure 5B:
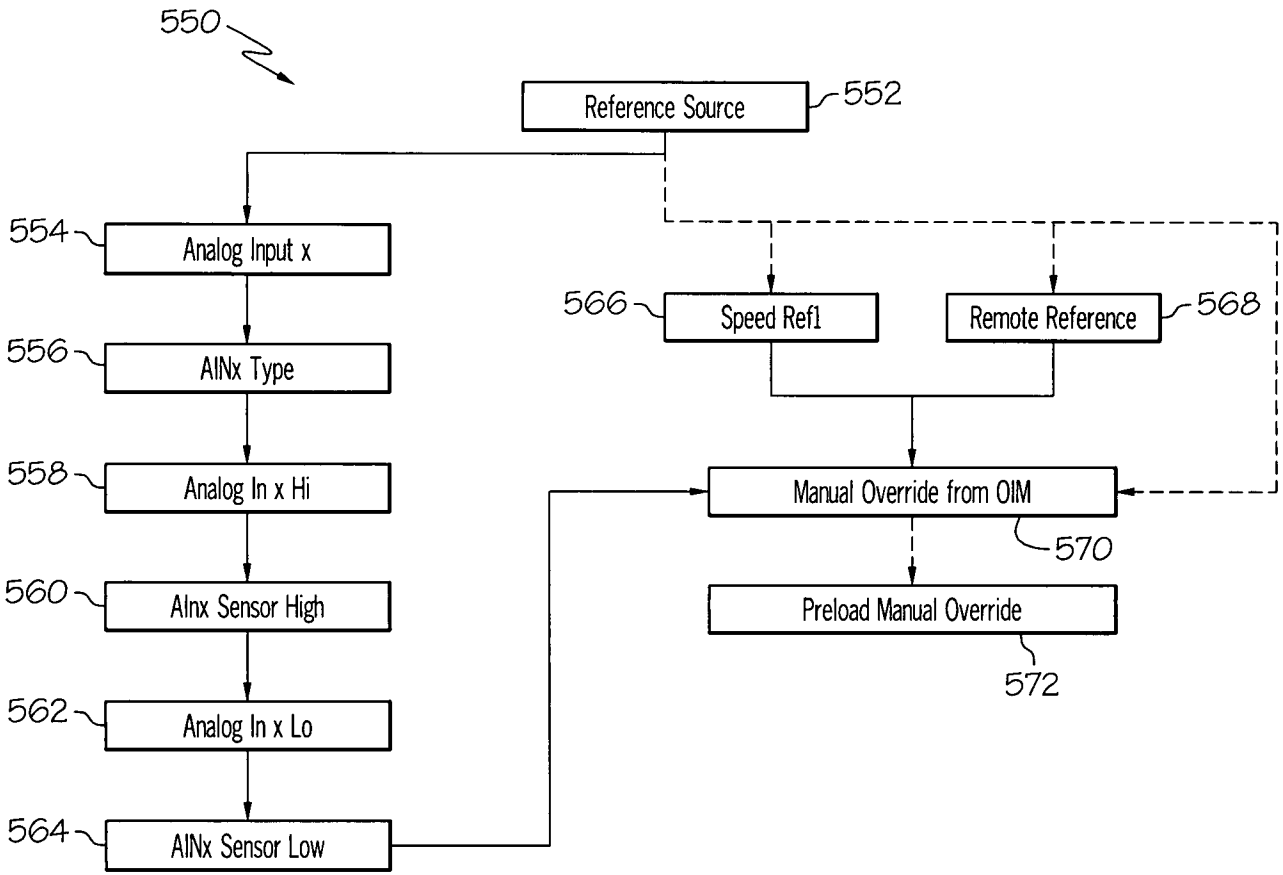
FIG. 5B is a flow chart depicting a reference source set up associated with the speed control mode of the controller.

Reference now is made to FIG. 5B, which shows in greater detail the speed mode setpoint information 550 requested by the software 80 and entered into data 110 of the controller 30 by the user via the user interface 100 if selected in step 206 (FIG. 2). In step 552, the user selects from where the speed setpoint is referenced (REFERENCE SOURCE). The choices available are the user interface 100, a remote reference, and analog input. In the follow example, analog input is selected. In step 554, the user then selects whether the analog input designated as Analog Input x is ether Analog Input m or Analog Input n. In step 556, the user selects "Current" if the sensor connected to Analog Input n is a current sensor, or "Voltage" if the sensor connected to Analog Input x is a voltage sensor (AINx TYPE). In step 558, the user enter the maximum input signal of the sensor connected to Analog Input x (e.g. 20 mA or 10 VDC)(ANALOG IN x HI). In step 560, the user enters the speed value that corresponds to the maximum input signal of the sensor connect to Analog Input x (e.g. 60 Hz=20 mA)(AINn SENSOR HIGH). In step 562, the user enters the minimum input signal of the sensor connect to Analog Input x (e.g. 4 mA or 2 VDC)(ANALOG IN x LO). In step 564, the user enters the speed value that corresponds to the minimum input signal of the sensor connect to Analog Input x (e.g. 10 Hz=4 mA)(AINx SENSOR LOW).

Had the user selected either the user interface 100, the speed reference, or the remote reference in step 552, steps 554-564 would have been skipped by the software 80. If the user selects speed reference, then in step 566 the user is prompted by the software 80 to enter the value for speed reference (SPEED REF1). This value SPEED REF1 is then the speed setpoint value for controller 30. If the user selects remote reference, then in step 568 the user selects the interface connection (e.g. port number, network address, etc.) of the remote reference providing the speed setpoint value (REMOTE REFERENCE). After step 564, 566, or 568, the user is then prompted by the software 80 in step 570 to set the availability of manual override control from the user interface 100 (MANUAL OVERRIDE FROM OIM). Just as with the process mode setpoint information, the user select "Yes" to enable the manual override functionality (i.e. AUTO/MAN button) on the user interface 100, or "No" to disable this functionality. Next, if the user had selected "Yes" in step 570, then in step 572, the user is requested to select which reference speed to use on manual over (PRELOAD MANUAL OVERRIDE). If the user selects "Yes" then in manual override the software will load the current operating speed as the reference speed. If the user selects "No" then software will load the speed reference being entered manually by the user via the user interface 100 when manual override is activated. If a digital input is used to activate manual override mode while the system is running in process mode or speed mode, then the reference speed is determined by the preselected digital input. As mentioned above, after entering the above setpoint information, the controller 30 is ready to run with no pump protection from the IPS monitors, if such is a desire. The software monitors are now discussed in greater detail hereafter.

IPS Monitors

It is to be appreciated that the IPS (intelligent pump system) monitors are software agents that provide monitoring and protection features to the pump system. In one embodiment, the IPS monitors are software based and implemented directly onboard the VFD 20, utilizing the VFD's internal processing and power measurement capabilities. Such an embodiment eliminates the need for external power measurement sensors and external processing device. In other embodiments, the IPS monitors can also be implemented using an external processor with the power signal from the VFD or an external processor and external power sensors.

Turning back to FIG. 2, if the user wished to activate one of the IPS monitors, then in step 208 from a quick start menu 212 which is provided on the user interface 100, the user selects which IPS monitor to activate. As shown on the quick start menu, the available IPS monitors are Pump Power Monitor (PPM) 600, Process Variable Monitor (PVM) 700, Pump Condition Monitor (PCM) 800, Digital Input Monitors (DIM) 900, and the Automatic Setpoint Adjustment Monitor (ASAM) 1000. The PPM 600 is discussed in greater details hereafter with reference made to FIG. 6.

Pump Power Monitor

The Pump Power Monitor (PPM) is used in either process or speed control mode to detect pump operation at power levels above or below predetermined normal levels. The present invention only requires storage of one speed and the corresponding high and low power limits at that speed. With that information, the present invention dynamically computes upper and lower power limits, and will provide a response, such as stopping the motor, if actual power is outside one of the limits. In particular, the present invention uses the affinity relationship that power is proportional to the speed cubed to determine the upper and lower power limits at a new pump speed. It is to be appreciated that the computations are formed as a function of speed and not frequency of the motor with fixed power loses taking into account. Also, The present invention does not require an external sensor, nor does it require performance values calculated at multiple speeds to be stored. Accordingly, the present invention does not require generation of any unique performance curves, i.e. TDH vs. Torque. In addition, the power limits can be selected from the pump's standard performance curves or specific values provided with pump selection/specification documents in order to protect the pump. Limits can also be selected by the customer that not only protect the pump, but may be required to protect the process. An optional motor efficiency factor can be entered as well as time delay values to allow the pump to attempt to attain normal operation and prevent spurious alarms or warnings. A list of user selectable actions that the VFD can execute upon detection of an out of limits condition is also provided.

Figure 6:
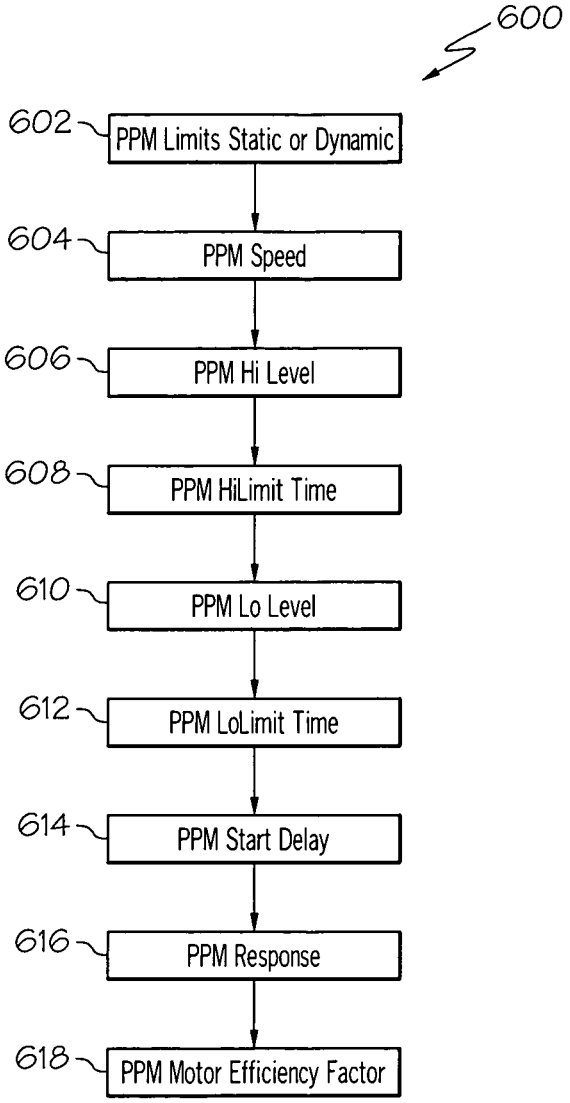
FIG. 6 is a flow chart depicting a Pump Power Monitor (PPM) logic module associated with the controller.

FIG. 6 shows in greater detail the setup information of the PPM 600 requested by the software 80 and entered into data 110 of the controller 30 by the user via the user interface 100 if selecting the PPM of the present invention in step 208 from the quick start menu 212 (FIG. 2). Next, in step 602, the user sets PPM LIMITS value to either "Static" to monitor two fixed power limits, or "Dynamic" to monitor power based on power limits set and adjusted by Affinity Laws. In static mode, the power limits are fixed values and are not dynamically scaled. If static mode is used, the appropriate upper and lower power limit settings for the fixed values can be obtained from the pump performance curve or pump selection data. In dynamic mode, the power limits (PPM Hi Limit, PPM Lo Limit) are dynamically adjusted for speed based on pump Affinity Law calculations. In step 604, the user sets a PPM SPEED value which is the speed used to calculate the dynamic power limits based on the Affinity Laws. It is also used along with the existing pump speed and pump Affinity Laws to recalculate the power limits based on current pump speed if the dynamic mode for the pump limits is enabled in step 602. An example of this recalculation is provided in a later section.

In step 606, the user enters optionally the maximum operating power before an action is taken (PPM Hi Level). The high power limit is typically set for the lowest of: power at the end of the pump performance curve; maximum rated motor power; or power rating of the magnetic coupling of a magnetic drive pump or canned motor pump. In step 608, the user enters the maximum time the power can be equal to or above the PPM Hi Level (PPM HILIMIT TIME), if so entered. In step 610, the user enters the minimum operating power before an action is taken (PPM Lo Level). The low power limit is typically set for the highest of the performance curve of the pump or the power required at minimum continuous recommended flow. In step 612, the user enters the maximum time the power can be equal to or below the PPM Lo Level (PPM LoLimit Time) before any selected response actions is initiated. The delay time should be set to accommodate normal process fluctuations but which does not allow the pump to operate at low power (low flow) conditions that may result in damage to the pump.

The PPM also provides a user settable time delay (PPM START DELAY) before protective action based on limit settings is initiated by the controller 30 in order to allow the pump 50 to attain normal operation during startup and to help avoid spurious responses caused by normal process fluctuations. In step 614, the user enters the amount of time before any PPM action can be taken at start-up or restart of the motor and pump. The high and low power limits are disabled during this time period. Also, a default value is provided but should be adjusted per application characteristics. It is to be noted that the PPM Start Delay is separate from an IPS Start Delay, and runs concurrently with it. The IPS Start Delay, since common to all IPS monitors, is explained in greater details in a later section. As such, the PPM Start delay enables the use of a different (longer) time delay with power monitoring protection for the startup of applications such as self-priming that may require the longer time periods before attaining normal operating conditions.

In step 616, the user selects the action that the PPM takes when an out of limit event occurs (PPM RESPONSE). The selectable responses are No Action (default), Message Only, Pump Shutdown, Speed Override, and Process Override, wherein Table 1 shows the available action that the PPM can initiate.

Finally, in step 618, the user may enter optionally a percent of motor efficiency (if known) to enable the estimation of power to the pump based on motor efficiency. The default is 100%. Power measurements provided by the VFD are indicative of power output from the VFD to the motor. The motor efficiency affects the actual power delivered to the pump. Since it is of interest to know power delivered to the pump by the motor, the motor efficiency should be accounted for if known.

TABLE 1

| Action | Description |
|---|---|
| No Action | PPM feature is disabled |
| Message Only | Messages displayed on the user interface in a Drive Status field<br>1) "PPM Hi Warn" - Power is above the high power limit<br>2) "PPM Lo Warn" - Power is below the low power limit |
| Pump Shutdown | Pump is stopped.<br>1) "PPM Hi Shtdn"- Status message displayed if PPM high power limit initiated the shutdown<br>2) "PPM Lo Shtdn" - Status message displayed if PPM low power limit initiated the shutdown<br>3) "Faulted PPM Shutdown"- fault pop-up box is displayed<br>4) "PPM Shutdown"- Message stored in the fault queue |
| Speed Override | Control mode changes to Speed mode. Speed setpoint changed to alternate programmable preset speed.<br>1) "PPM Hi SpdOv" - Status message displayed if a high power condition initiated the override<br>2) "PPM Lo SpdOv" - Status message displayed if a low power condition initiated the override<br>3) "PPM Spd Override" -- Message is stored in the alarm queue |
| Process Override | Valid only in Process Mode. Process setpoint changed to alternate programmable preset process setpoint.<br>1) "PPM Hi PrcOv" - Status message displayed if the high power condition initiated the override<br>2) "PPM Lo PrcOv" - Status message displayed if the low power condition initiated the override<br>3) "PPM Prc Override"- Message is stored in the alarm queue |

The PPM operates by internally monitoring the output power from the VFD to the pump motor. No external sensor is needed. The motor efficiency factor can be entered to enable a better estimation of the power directly to the pump. The PPM is used to detect pump operations at power levels above or below either pre-set expected normal levels or upper and lower power dynamically changing limits continuously calculated using Affinity laws. Abnormal power levels may indicate pump equipment problems or operating conditions that may be detrimental to the pump and/or the process. For example, the PPM can be used to detect underload and overload conditions such as dry running, blocked lines, cavitation or excessive wear and rubbing. Upon detection of power levels that are outside of the power limits, an appropriate action, selected from the list of PPM Response Actions, such as provided in Table 1, can be automatically initiated. Adjustable time delays entered during the PPM setup are provided to allow the pump to attain normal operating process fluctuations. A retry feature is provided to allow the controller to attempt to re-establish normal operation after a preset time delay. The retry feature since available to all of the IPS monitors is explained in a later section.

The PPM displays on the user interface 100 power directly in power units as horsepower or kilowatts. This allows the upper and lower limits to be determined directly from the pump manufacturer's pump performance curves or pump selection data without having to operate the pump at extremes to determine these power limits. It is to be noted that prior art power level monitoring methods typically require limits to be set using motor amperage values or percentages of full load, neither of which typically are supplied as part of pump performance specifications. With such prior art methods, this may require operating the pump at potentially detrimental extremes to measure the values in order to obtain the power limit settings. With the present invention, setting power limits without having to operate the pump to determine them adds both simplicity to the setup and protection to the pump upon initial startup or commissioning.

As mentioned above, the PPM is intended to protect the pumping equipment and process from conditions detectable by over (too high) and under (too low) power measurement. VFD's typically incorporate equipment protection techniques onboard. But, these techniques are generally "overload" protection based on amperage or torque measurement or estimation. It is also to be appreciated that the use of variable frequency drives with centrifugal pumps presents a challenge in setting normal high and low power limits since those values (limits) can be dependent upon the speed at which the pump is operating. If the limits are set at one operating speed and the speed changes due to process requirements, the fixed limits may no longer be adequate to provide equipment protection or provide useful pump diagnostic information.

The PPM provides the dynamic mode feature that will automatically (dynamically) adjust the high and low power limits utilizing Pump Affinity Laws for centrifugal pumps that define the relationship between pump power at a given speed and the power at any other speed. This feature allows high and low power limits to be set using the limits known at any one speed. The limits will then be automatically adjusted by the power monitor for any new speed. To illustrate this feature of the PPM, the following example is provided.

As mentioned above, and as used in this example, the following information entered by the user during PPM set-up and provided by the VFD is as abbreviated and noted as follows: "N1" is the operating speed at which the upper and lower power limits are known. "P1 UL" is the upper (high) power limit at N1. Note, if operating power exceeds this value, the selected action PPM RESPONSE is initiated. "P1 LL" is the lower power limit at N1. Note, if operating power falls below this value, the selected action PPM RESPONSE is initiated. "Start Up Time Delay" in seconds is the time period after the motor is started that must expire before any action can be initiated by the power monitor. "High Limit Time Delay" in seconds is the time period that operating power must exceed the high limit before action can be initiated. Also, Start up delay must have expired before this delay is utilized. "Low Limit Time Delay" in seconds is the time period that operating power must be below the low limit before action can be initiated. Also, Start up delay must have expired before this delay is utilized. "Motor Efficiency" in percentage (%) is optional, and has a default of 100%.

It is to be noted that shaft output power is calculated by motor efficiency x VFD output power. "PPM Limits adjustment enable" in static mode limits are fixed values, and in dynamic mode the limits are automatically re-calculated for operating speed using Affinity Laws for centrifugal pumps. "N2" is the current motor speed which is an internal VFD parameter continuously updated by the VFD. The "Speed Feedback" VFD parameter is used to estimate actual motor speed. It is used without requiring external encoder feedback to estimate actual motor speed. This is a different parameter than "Output Frequency" that keeps track of the VFD's output frequency. Actual motor operating speed can be different from the VFD's output frequency value due to motor loading and slippage. The present invention is setup to use "Sensorless Vector Control" operating mode. This mode allows speed estimation using the speed feedback parameter to be closer to actual operating speed than the typical "Volts/Hertz" mode. "P2 Upper Limit" is calculated by the processor using the Affinity law for centrifugal pumps for power, i.e $$\left(\frac{P_1}{P_2}\right) = \left(\frac{N_1}{N_2}\right)^3$$

where P1 is the upper power limit at N1 RPM entered by the user and P2 is the new upper power limit calculated at N2 (the current operating speed) by the VFD. The equation can be re-arranged for implementation as $$P_2 = P_1 \times \left(\frac{N_2}{N_1}\right)^3.$$

"P2 Lower Limit" is calculated by the processor using the Affinity law for centrifugal pumps for power, i.e.

$$\left(\frac{P_1}{P_2}\right) = \left(\frac{N_1}{N_2}\right)^3$$

where P1 is the lower power limit at N1 RPM entered by the user and P2 is the new lower power limit calculated at N2 (the current operating speed) by the VFD. The equation can be re-arranged for implementation as $$P_2 = P_1 \times \left(\frac{N_2}{N_1}\right)^3.$$

Shaft power out is the power value calculated by the VFD using (motor efficiency x VFD power out). This is the power value that high and low power limits are compared against to determine if an out of limits condition exists.

With the above in mind, in use, the user knows from the Manufacturer's performance data that the pump is available for operation at 1800 RPM which is entered as N1. The End of Curve (EOC) flow (maximum flow rate) is 1,500 gpm. The power at EOC is 40 Hp. This value is entered as the High power limit (P1 UL). The minimum allowable flow rate is stated as 150 gpm. The power at minimum allowable flow is 25 Hp. This value has been entered as the Low power limit (P1 LL). The pump is now actually operating at 1600 RPM. With the PPM in dynamic mode, the High power limit (P1 UL) at the new speed is automatically re-calculated using the equation:

$$P1UL_{new} = P1UL_{old} \times \left(\frac{N_2}{N_1}\right)^3.$$

Using this equation, the new High power limit (P1$UL_{new}$) at 1600 RPM=40 HP×(1600/1800)^3=28.09 HP. The new Low power limit is also automatically re-calculated using the equation $$P1LL_{new} = P1LL_{old} \times \left(\frac{N_2}{N_1}\right)^3.$$

The new Low power limit (P1$LL_{new}$) at 1600 RPM=25 HP×(1600/1800)^3=17.55 HP. Since speed may be continuously changing to attain desired process operating conditions, the power limits are also automatically re-adjusted based on any new speed. Next, the Process Variable Monitor (PVM) is discussed in greater detail.

Process Variable Monitor

Figure 7:
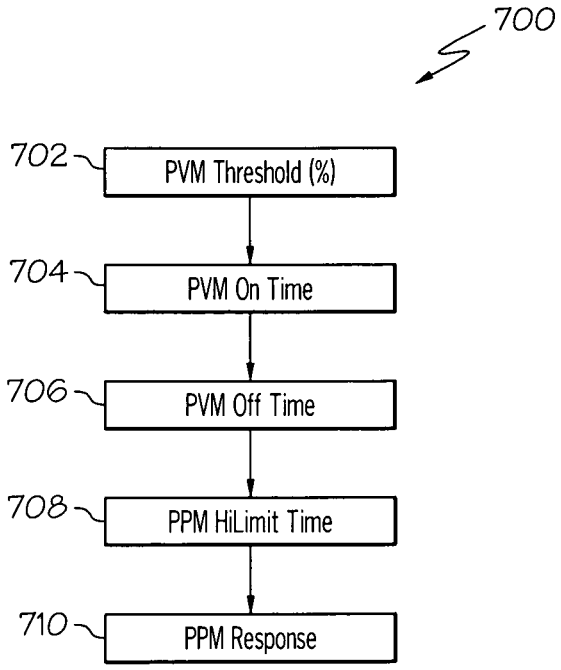
FIG. 7 is a flow chart depicting a Pump Variable Monitor (PVM) logic module associated with the controller.

The PVM can be used while operating in Process control (PI) mode to detect a process no longer controllable within the set operating limits of the controller 30. This may be due to a change in process fluid or system characteristics, loss of adequate suction, or equipment failure or wear. FIG. 7 shows in greater detail the setup information of the PVM 700 requested by the software 80 and entered into data 110 of the controller 30 by the user via the user interface 100 if selecting the PVM of the present invention in step 208 from the quick start menu 212 (FIG. 2). In step 702, the user enters the positive and negative threshold (in percent) that the process variable being monitored must remain within before the PVM triggers a specified action (PVM THRESHOLD). In step 704, the user enters the amount of time the process variable being monitored must be outside the threshold value before the PVM triggers a specified action (PVM ON TIME). In step 706, the user enters the amount of time the process variable being monitored must be inside the threshold value before the PVM resets (PVM OFF TIME). Finally, in step 708, the user selects the specified action that the PVM takes when an out of limit event occurs (PVM RESPONSE), which are listed in Table 2 below.

The PVM operates by monitoring the speed required to maintain the required process setpoint. The motor data/tune information includes, inter alia, the maximum and minimum speeds that the pump should run in the process to maintain the desired flow rate. Such information is used as the minimum and maximum references for the PVM. Accordingly, the PVM detects when a process is no longer controllable within the present operating speed limits, and can initiate an alternative pre-established process setpoint, switch to speed mode at a pre-established speed setpoint or take other action as listed in Table 2 to optimize plant output and pump availability. If the required setpoint for the controlled process variable (i.e., psi, flow, etc.) cannot be attained within the IPS Tempo's preset maximum and minimum speed limits, the PVM response action will automatically be initiated. Adjustable time delays entered during setup are provided to allow the pump to attain normal process fluctuations. A retry feature is provided to all the IPS monitors to re-establish normal operation after a preset time delay. As mentioned above in a previous section, the present invention stores motor data/tune information.

TABLE 2

| Action | Description |
|---|---|
| No Action | PPM feature is disabled |
| Message Only | Messages displayed on the user interface in a Drive Status field<br>3) "PVM Hi Warn" - Maximum speed and setpoint is not attained<br>4) "PVM Lo Warn" - Minimum speed and setpoint is not attained |
| Pump Shutdown | Pump is stopped.<br>1) "PVM Hi Shtdn"- Status message displayed if PVM maximum speed condition initiated the shutdown<br>2) "PVM Lo Shtdn" - Status message displayed if PVM minimum speed condition initiated the shutdown<br>3) "Faulted PVM Shutdown"- fault pop-up box is displayed<br>4) "PVM Shutdown"- Message stored in the fault queue |
| Speed Override | Control mode changes to Speed mode. Speed setpoint changed to alternate programmable preset speed.<br>1) "PVM Hi SpdOv" - Status message displayed if the max spped condition is initiated<br>2) "PVM Lo SpdOv" - Status message displayed if a minimum speed condition is initiated<br>3) "PVM Spd Override" -- Message is stored in the alarm queue |
| Process Override | Valid only in Process Mode. Process setpoint changed to alternate programmable preset process setpoint.<br>1) "PVM Hi PrcOv" - Status message displayed if the maximum speed condition initiated the override<br>2) "PVM Lo PrcOv" - Status message displayed if the minimum speed condition initiated the override<br>3) "PVM Prc Override"- Message is stored in the alarm queue |

To determine flowrate, an external flowmeter is used. The flowmeter can be a direct flowrate reading device or a differential pressure style flowmeter. However, it is to be noted that the present invention does not perform TDH calculations as mentioned above. Also, there is no response taken by the controller 30 to ensure that the speed signal produced is only for a speed that will produce a flow rate resulting in a pump pressure with a non-positive slope.

Pump Condition Monitor

The PCM can be used to detect abnormal pump or process conditions by monitoring the signal from a sensor connected to one of the IPS Tempo's analog input channels. The PCM can then initiate the appropriate action selected from a list of available response actions when an abnormal pump or process operating conditions is detected. The PCM can be used while operating in either process control mode or speed control mode. Examples of monitored conditions include: Vibration, Lube health, Temperature, Pressure, and Flow.

Figure 8:
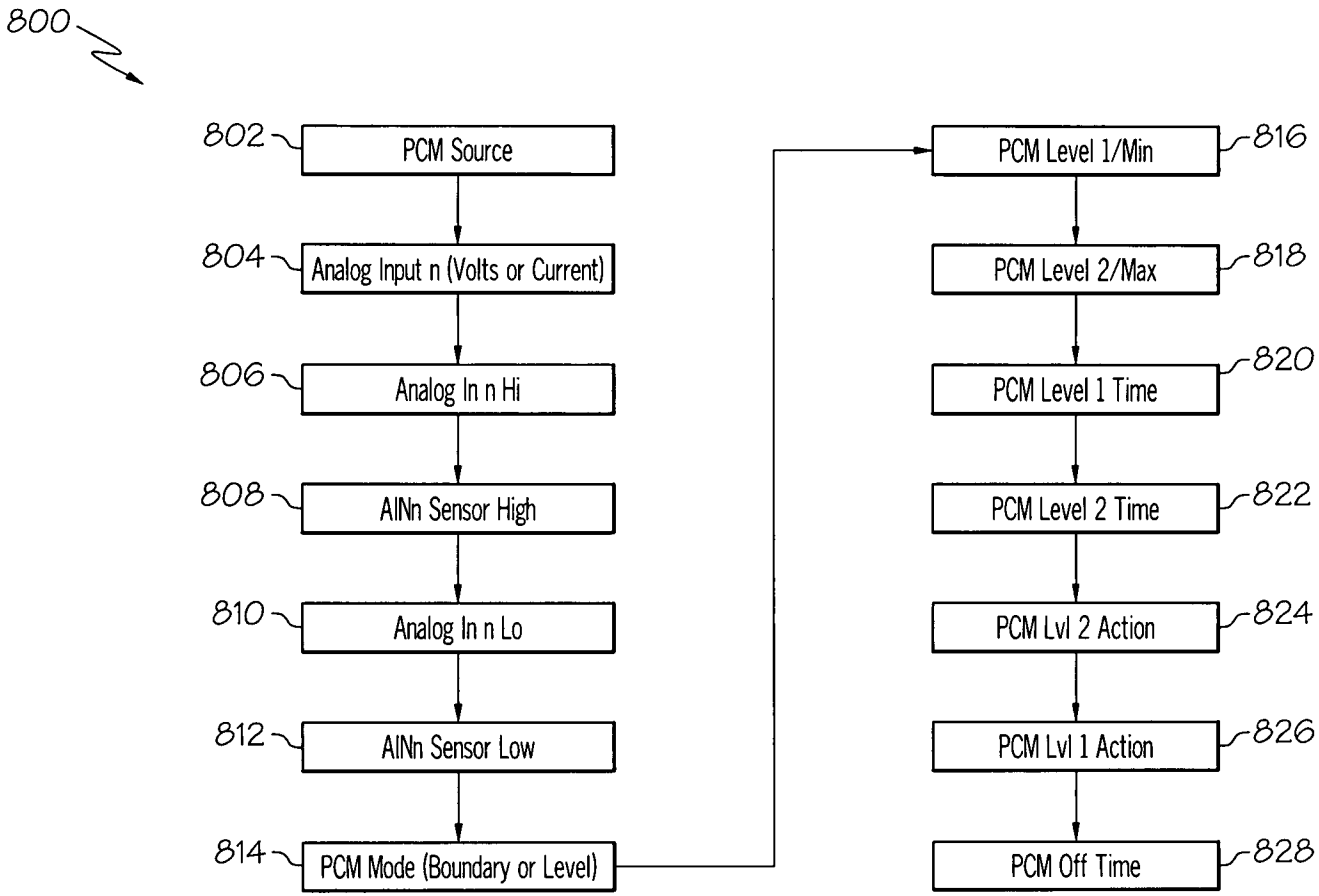
FIG. 8 is a flow chart depicting a Pump Condition Monitor (PCM) logic module associated with the controller.

FIG. 8 shows in greater detail the setup information of the PCM 800 requested by the software 80 and entered into data 110 of the controller 30 by the user via the user interface 100 if selecting the PCM of the present invention in step 208 from the quick start menu 212 (FIG. 2). In step 802, the user selects the source of the signal that the PCM checks (Analog2 Value is the default)(PCM SOURCE). The source for the monitored sensor signal can be from either of the two analog input channels, Anlg1 or Anlg2. The sensor signal from an analog input channel can optionally be further scaled by using one of the four scale blocks of the controller 30 prior to processing by the PCM. In steps 804-812, the user sets up the selected analog input. Since these step are same as steps 506-514 performed during the setup of the Setpoint for Process Mode (FIG. 5A), no further discussion is provided.

In step 814, the user selects either "Boundary mode or "Level" mode (Level is the default)(PCM MODE). There are two operating modes for the PCM: Level (signal threshold) and Boundary. The signal threshold Level mode provides two separate adjustable levels. It acts based upon the sensor signal crossing one or both preset levels in the same direction (rising or falling), i.e., "High" and "Higher" or "Low" and "Lower." Each level can initiate a separate response. The Boundary mode action is based upon the sensor signal rising above the preset "Max" value or dropping below the preset "Min" value. Accordingly, in step 816, the user specifies the minimum PCM limits in Boundary mode or Level 1 limits in Level mode (PCM LEVEL 1/MIN). In Level mode, it is the first of the two levels to be crossed to initiate a PCM response. In Boundary mode, it is the value that the sensor signal must be below for any PCM response action to be initiated. In step 818, the user specifies the maximum PCM limits in Boundary mode or Level 2 limits in Level mode (PCM LEVEL 2/MAX). In Level mode, it is the second of the two levels to be crossed to initiate a PCM response. In Boundary mode, it is the value that the sensor signal must exceed before any PCM response action to be initiated.

In step 820, the users enters the maximum time that the monitored signal can be outside Level 1 before the action is initiated (PCM LEVEL 1 TIME). In step 822, the user enters the maximum time that the monitored signal can be outside Level 2 before the action is initiated (PCM LEVEL 2 TIME). In step 824, the user selects the action that the PCM takes when an out of limit event (outside of Level 2) occurs (PCM LVL 2 ACTION). In step 826, the user selects the action that the PCM takes when an out of limit event (outside of Level 1) occurs (PCM LVL 1 ACTION). The actions are listed in Table 3 below.

TABLE 3

| Action | Description |
|---|---|
| No Action | PPM feature is disabled |
| Message Only | Messages displayed on the OIM in the Drive Status field<br>1) "PCM Hi Warn" -- Status message is displayed if the maximum boundary (Boundary) or "Level 2" (Level) are exceeded<br>2) "PCM Lo Warn" -- Status message is displayed if "Level 1" (Level) is exceeded of if the value has dropped below the minimum boundary (Boundary) |

TABLE 3-continued

| Action | Description |
|---|---|
| Pump Shutdown | Pump is stopped<br>1) "PCM Hi Shtdn" -- Status message is displayed if the monitored condition is above "Level 2" (Level) or "Max" (Boundary)<br>2) "PCM Lo Shtdn" -- Status message is displayed if the monitored condition is above "Level 1" (Level) or below "Min" (Boundary)<br>3) "Faulted F.142 PCM Shutdown" -- IPS Tempo fault pop-up box is displayed<br>4) "PCM Shutdown" -- Message is stored in the fault queue |
| Speed Override | Control mode changes to Speed mode. The speed setpoint is change to an alternate programmable preset speed<br>1) "PCM Hi SpdOv" -- Status message is displayed if the monitored condition above "Level 2" (Level) or "Max" (Boundary) initiated the override<br>2) "PCM Lo SpdOv" -- Status message is displayed if the monitored condition above "Level 1" (Level) or below "Min" (Boundary) initiated the override<br>3) "PCM Spd Override" -- Message is stored in the alarm queue |
| Process Override | Valid only in Process Mode. The process setpoint is change to an alternate programmable preset process setpoint.<br>1) "PCM Hi PrcOv" -- Status message is displayed if the monitored condition above "Level 2" (Level) or "Max" (Boundary) initiated the override<br>2) "PCM Lo PrcOv" -- Status message is displayed if the monitored condition above "Level 1" (Level) or below "Min" (Boundary) initiated the override<br>3) "PCM Prc Overide" -- Message is stored in the alarm queue |

In step 828, the user specifies the amount of time (for either level) that must elapse before the out of range condition is considered reset (PCM OFF TIME). The PCM Level and Off Time delays are provided to avoid spurious PCM responses caused by normal process fluctuations. A retry feature is provided to allow the controller to attempt to re-establish normal operation after a preset time delay. The retry feature is discussed in a later section.

Digital Input Monitors

Digital Input Monitors (DIM) are used to detect and respond to conditions or events indicated by discrete (On/Off) switching devices connected to one of the three digital input channels. Such discrete switching devices are, for example, limit switches, level switches, pressure switches, temperature switches, flow switches, relay contacts, and the like. Each DIM can be used in Process control (PI) mode or Speed control mode.

Figure 9:
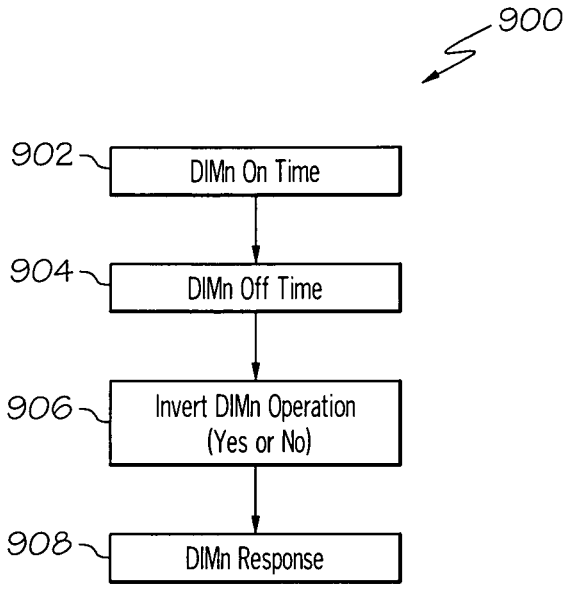
FIG. 9 is a flow chart depicting a Digital Input Monitors (DIM) logic module associated with the controller.

FIG. 9 shows in greater detail the setup information of each of the DIMs 900 requested by the software 80 and entered into data 110 of the controller 30 by the user via the user interface 100 if selecting one of the DIMs of the present invention in step 208 from the quick start menu 212 (FIG. 2). In step 902, the user enters the amount of time required to activate the DIM (DIMN ON TIME). This is the adjustable time period that must expire after a DIM input senses the "On" state before the selected DIM response is initiated. In step 904, the user enters the amount of time required to deactivate the DIM6 (DIMN OFF TIME). This is the adjustable time period that must expire after a DIM input senses the "Off" state before the DIM "On" state is re-established. In step 906, the user set the operation of the DIM (INVERT DIMN OPERATION) The user selects "No" for normal operation (high equals On), and selects "Yes" for inverted operation (low equals On). In step 908, the user selects the action that the DIM takes upon activation (DIM6 RESPONSE). The available response are listed in Table 4 below.

TABLE 4

| Action | Description |
|---|---|
| No Action | PPM feature is disabled |
| Message Only | Messages displayed on the OIM in the Drive Status field<br>1) "DIMn Hi Warn" -- DIMn at "High" (1) state<br>2) "DIMn Lo Warn" -- DIMn at "Low" (0) state |
| Pump Shutdown | Pump is stopped<br>1) "DIMn Hi Shtdn" -- Status message is displayed if a "High" (1) state on digital input n initiated the shutdown<br>2) "DIMn Lo Shtdn" -- Status message is displayed if a "Low" (0) state on digital input n initiated the shutdown<br>3) "Faulted DIMn Shutdown" -- Controller fault pop-up box is displayed<br>4) "DIMn Shutdown" -- Message is stored in the fault queue |
| Speed Override | Control mode changes to Speed mode. The speed setpoint is change to an alternate programmable preset speed<br>1) "DIMn Hi SpdOv" -- Status message is displayed if a "High" (1) state on digital input n initiated the override<br>2) "DIMn Lo SpdOv" -- Status message is displayed if a "Low" (0) state on digital input n initiated the override<br>3) "DIMn Spd Override" -- Message is stored in the alarm queue |
| Process Override | Valid only in Process Mode. The process setpoint is change to an alternate programmable preset process setpoint.<br>1) "DIMn Hi PrcOv" -- Status message is displayed if a "High" (1) state on digital input n initiated the override<br>2) "DIMn Lo PrcOv" -- Status message is displayed if a "Low" (0) state on digital input n initiated the override<br>3) "DIMn Prc Override" -- Message is stored in the alarm queue |

The DIM operates by monitoring the "ON" and "OFF" status of the digital inputs of the controller 30. The ON and OFF states of the digital inputs are determined by the voltage levels applied to them as defined in the I/O specification. Upon detection of a DIM ON state, the response action of the controller 30 that was selected during the DIM setup is initiated. Time delays are provided and configured during DIM setup. Time delays enable the pump to attain normal operating conditions during pump starting. They also allow the pump to avoid spurious DIM responses caused by normal operation after a DIM has initiated a response action and a preset time period has expired.

Auto Setpoint Adjustment Monitor

The Auto Setpoint Adjustment Monitor (ASAM) is used to automatically modify (adjust) a process control or speed setpoint in response to a signal from an analog sensor (e.g., sensor 170 or 180)(FIG. 1) connected to one of the analog input channels (Analog In n) of the controller 30 that utilizes a customizable input-output relationship defined by multiple input/output data value pairs provided in a scaling table. In particular, the sensor signal is acted upon by a programmable multi-point scaling operation defined by the scaling table that determines the effect of the signal on the process control or speed setpoint. The multi-point scaling table consists of ten pairs of values. Each pair contains an "Input Signal %" that can range from 0% to 100% and an "Output Scaler %" that can range from 0% to 150%. The signal from the analog input (Analog In n), in the range of 0% to 100% as defined by Analog In n Lo and Analog In n Hi during the setup procedure of the controller 30, is compared to the "Input Signal %" values in the scaling table. The "Output Scaler %" in the scaling table pair at which the Analog Input n % matches the "Input Signal %" becomes the setpoint multiplier value. Interpolation is used to calculate values that fall between points in the scaling table. In order to use the ASAM it must be enabled, speed or process control setpoint selected, and the multi-point scaling table populated with value pairs that result in the desired setpoint scaling profile. This is accomplished using the ASAM setup menu selected from the quick start menu 212 (FIG. 2).

Figure 10:
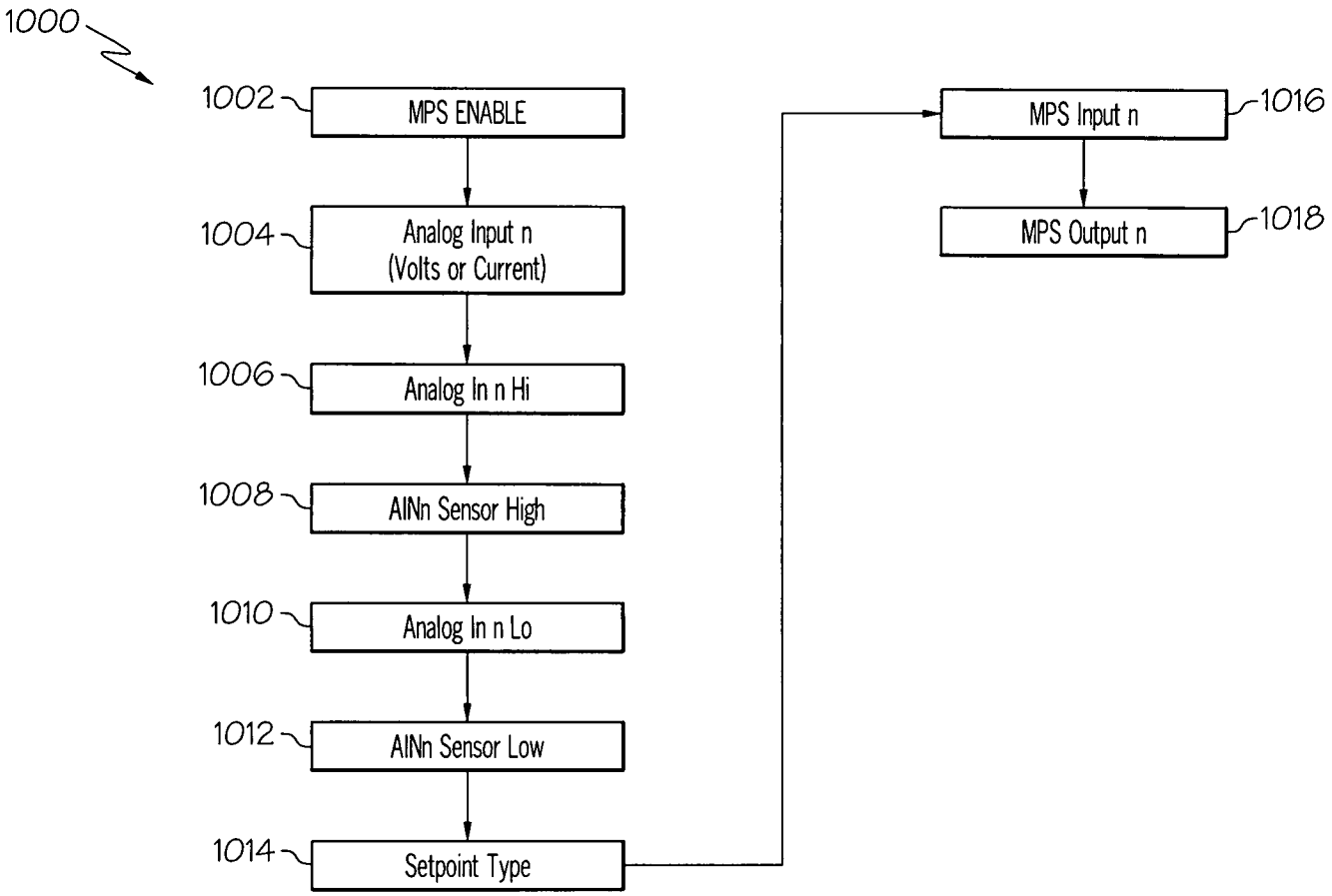
FIG. 10 is a flow chart depicting an Auto Setpoint Adjustment Monitor (ASAM) logic module associated with the controller.

FIG. 10 shows in greater detail the setup information of the ASAM 1000 requested by the software 80 and entered into data 110 of the controller 30 by the user via the user interface 100 if selecting the ASAM of the present invention in step 208 from the quick start menu 212 (FIG. 2). In step 1002, the user Select "On" to enable the ASAM (MPS ENABLE), wherein the default is "Off" which disables the ASAM. As mentioned above, enabling the ASAM allows it to modify the process or speed setpoint by applying a scaling multiplier calculated using a multi-point scaling table, which is explained in greater detail in a later section in reference to Table 5. In steps 1004-1012, the user sets up the selected analog input. Since these step are same as steps 506-514 performed during the setup of the Setpoint for Process Mode (FIG. 5A), no further discussion is provided. In step 1014, the user selects either "Speed" for speed mode, "Process" for process mode, or "Both" for controlling the active mode, either speed or process mode (SETPOINT TYPE).

In step 1016, the user enters into the scaling table values for the conversion of input values to output values of the selected process or speed reference, which is determined by selected control mode (speed or process). The scaling table comprises percent (%) values range from 0% to 100% of the ten input signal (MPS INPUTn (n=1 to 10)) and are the values that are compared with the values from an analog input (Analog In n) of the controller 30 that can also range from 0% to 100%. When a match is found, the output signal % paired with the matched input signal % becomes the output signal % scaling multiplier that is applied to the setpoint. Interpolation is used to determine values that fall between points in the conversion profile. Also, input values n+1 must be greater than input value n. The first input value does not need to be 0, and any value lower than the first input value will automatically be interpolated between 0 and that value in the scaling table.

Finally, in step 1018, the user enters values into the scaling table for the conversion of output values to control setpoint values of the selected control mode (process or speed mode). The percent (%) values of the ten output signals (MPS OUTPUTn (n=1 to 10)) can ranges from 0% to 150%. These values are used as scaling multipliers for the speed or process control setpoint. To effectively apply the ASAM, the input and output signal % values must be properly selected. This involves understanding the relationships between the measured parameter used to modify the speed or process setpoint and the resulting impact on the process and pump due to the setpoint change. System requirements can determine the amount of speed or process setpoint change that is allowable. For example, systems containing a static head component may limit speed to a value sufficient to overcome the static head and maintain adequate pump flow.

The following is an example of an application of the ASAM. The task monitored and performed safely by the ASAM is to empty a tank at a decreasing flow rate as the tank level decreases. The following system information is as follows: tank height is 50 feet; initial flow rate is 100 gpm; a flow feedback sensor attached to first analog input channel of the controller 30; and a tank level/pressure sensor is calibrated in feet is installed to measure the tank level. For this task, it is desired to permit the initial flow rate of 100 gpm until the tank level reaches 25 feet (50% maximum level). Starting at level of 25 feet, however, it is desired to reduce the flow rate by 15% (15 gpm) for each 10% (5 feet) reduction in level in order to provide a more controlled pump out and/or help prevent pump cavitation. The solution to the task is as follows.

First, the user configures a second analog input channel for the tank level sensor, and attaches the tank level sensor to second analog input in order to monitor the tank level. Second, the controller 30 is set to process control mode, and finally, the ASAM is enabled and the scaling table is configured using the information in Table 5 below.

The In % and Out % values shown in Table 5 are entered into the ASAM's MSP Input and Output value pairs in steps 1016 and 1018, respectively. The MPS Input and Output values can be modified as required to generate a desired operating setpoint profile. In this example, the ASAM In % represents the tank level in % of maximum level/pressure sensor value. The Out % represents the flow rate multiplier for the corresponding In % level sensor.

TABLE 5

(Scaling table)

| Tank Level (Feet) | Tank Level (Sensor %) | ASAM Data Pair | ASAM In % (% Tank Level Sensor) | ASAM Out % (Flow Rate Multiplier) | Resulting Flow Rate Setpoint (ASAM Out % × Initial Flow Rate) (gpm) |
|---|---|---|---|---|---|
| 5 | 10 | 1 | 10 | 40 | 40 |
| 10 | 20 | 2 | 20 | 55 | 55 |
| 15 | 30 | 3 | 30 | 70 | 70 |
| 20 | 40 | 4 | 40 | 85 | 85 |
| 25 | 50 | 5 | 50 | 100 | 100 |

TABLE 5-continued (Scaling table)

| Tank Level (Feet) | Tank Level (Sensor %) | ASAM Data Pair | ASAM In % (% Tank Level Sensor) | ASAM Out % (Flow Rate Multiplier) | Resulting Flow Rate Setpoint (ASAM Out % × Initial Flow Rate) (gpm) |
|---|---|---|---|---|---|
| 30 | 60 | 6 | 60 | 100 | 100 |
| 35 | 70 | 7 | 70 | 100 | 100 |
| 40 | 80 | 8 | 80 | 100 | 100 |
| 45 | 90 | 9 | 90 | 100 | 100 |
| 50 | 100 | 10 | 100 | 100 | 100 |

Figure 11:
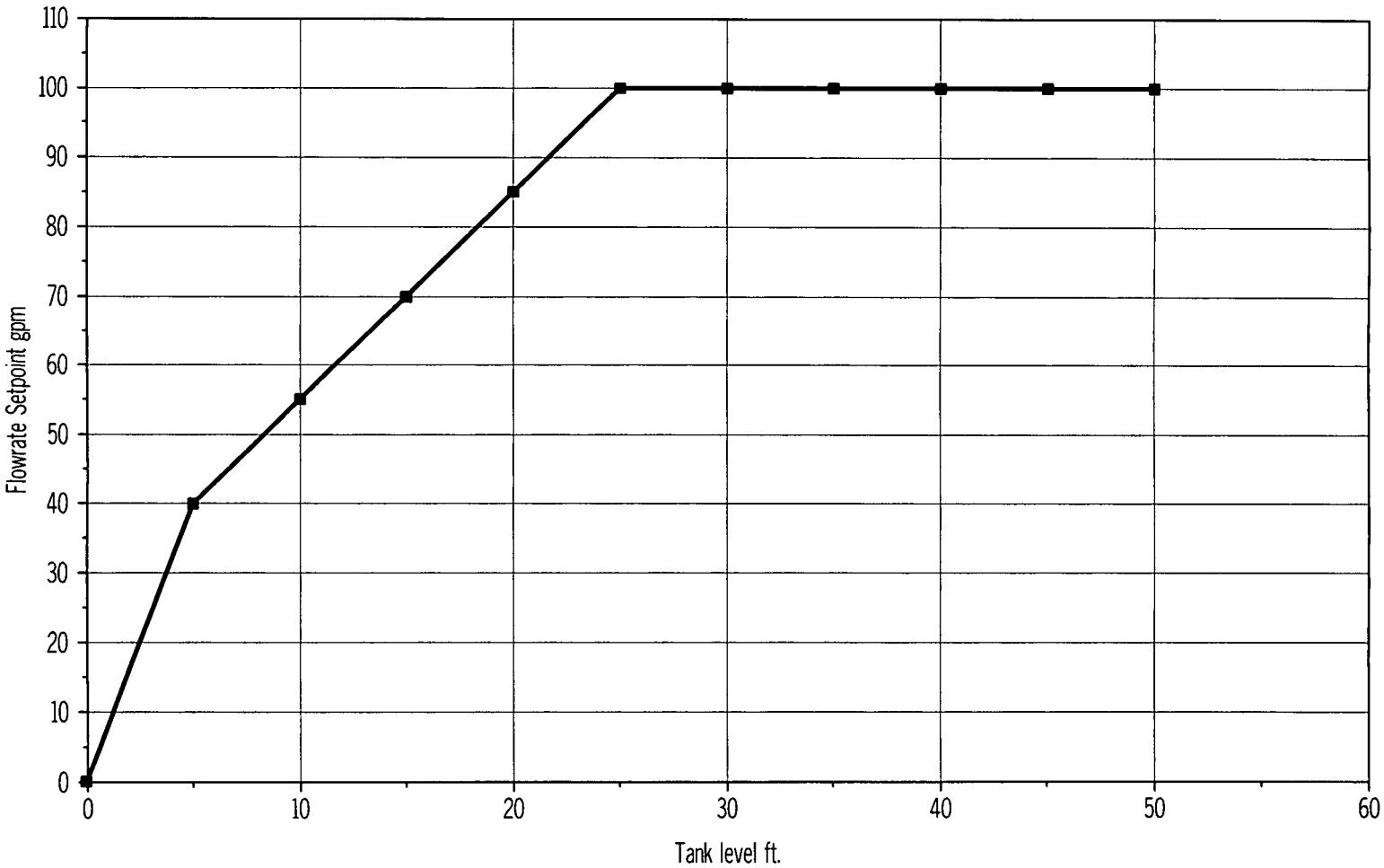
FIG. 11 is a plot of a change in flow rate controlled by the ASAM in an illustrative example according to the present invention.

Thus, as the tank level varies, the ASAM Out % value adjusts (scales) the flow rate setpoint. In this case, the flow rate setpoint is reduced by 15 gpm for each 5 foot drop below the feet level. FIG. 11 plots the change in flow rate controlled by the ASAM in this example.

In view of the above, it is to be noted that the ASAM is useful in applications such as "Load Out," where a suction pressure sensor is used to indicate the level in the vessel to be unloaded or the NPSH available to the pump. The ASAM provides a more controlled unload as well as reduces the possibility of cavitation due to insufficient NPSH available by slowing down the pump as the tank empties.

Global Actions

Finally, the present invention has global actions that can be initiated by all of the IPS Monitors 600, 700, 800, 900, 1000 and are configured separately from the individual monitors. These global actions include Energize Digital (Discrete) Output Relay, and Auto retry. For Energize Digital (Discrete) Output Relay, any of the digital output relays (Alarms 120, digital outputs 158) of the controller 30 can be activated. These digital output relays can be used to initiate other use defined actions such as, for example, condition annunciation using external lamps, beacons, sirens, condition signaling to an external controller, energizing other equipment (i.e., starting an additional pump), and the likes.

Auto retry will cause the controller 30, after a preset time delay, to attempt to re-establish normal operation (i.e., the speed or process setpoint prior to the detection of the condition that initiated the action). When auto restart is enabled by the user setting a value greater than zero for the number of restarts of the auto retry (Auto Rstrt Tries), and an auto reset fault occurs, the controller 30 will stop and remain in the fault condition. After the number of seconds in the user defined delay of the auto retry (Auto Restrt Delay) has elapsed, the controller 30 will automatically reset the faulted condition. The controller 30 will then issue an internal start command to restart. If another auto-resettable fault occurs, the cycle will repeat up to the number of attempts specified by the user (Auto Rstrt Tries) during set up.

If the controller 30 faults repeatedly for more than the number of attempts specified in Auto Rstrt Tries with less than five minutes between each fault, the controller 30 will remain in the faulted state. The fault Auto Rstrt Tries will be logged in the fault queue. The auto restart feature is disabled when the controller 30 is stopping and during autotuning. It is to be noted that a DC Hold state is considered stopping. The following conditions will abort the auto retry process: issuing a stop command from any control source; issuing a fault reset command from any active source; removing the enable input signal; setting Auto Restrt Tries to zero; occurrence of a fault that is not auto-resettable; removing power from the IPS Tempo; and exhausting an auto-reset/run cycle.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

We claim:

1. A method of controlling operation of a centrifugal pump in a fluid pumping system having a variable frequency drive (VFD) powering an alternating current (AC) motor which turns said centrifugal pump, said method comprising:

internally monitoring automatically output current and voltage of the VFD to the AC motor without the need for an external sensor;

calculating automatically output power based on monitored values of said output current and voltage and not on torque or speed of the AC motor;

checking automatically whether said calculated output power is above a predetermined high power limit for a desired setpoint;

checking automatically whether said calculated output power is below a predetermined low power limit for said desired setpoint, wherein said high and low power limits vary depending upon pump operating speed;

receiving feedback from an external process sensor, wherein said feedback is indicative of said desired setpoint;

and initiating automatically a first predetermined response action if said calculated output power is either above said predetermined high power limit or below said predetermined low power limit;

wherein said high power limit is set to lowest of either power at the end of a performance curve of the pump, maximum rated motor power, or power rating of magnetic coupling of a magnetic drive pump or a canned motor pump, and wherein said low power limit is set for the highest of the performance curve of the pump or power required at minimum continuous recommended flow;

using a high power level delay which is a time period that the output power must exceed the high power limit before said predetermined response action is initiated;

monitoring an externally provided analog sensor signal;

and initiating automatically a second predetermined response action if in a signal threshold level mode said analog sensor signal crosses one or both preset levels in the same direction, wherein each of said preset levels can initiate a separate response, or if in boundary mode, said analog sensor signal rising above a preset maximum value or drops below a preset minimum value, and in both modes, if after expiration of a time delay said analog sensor signal is still above one or both said preset levels if in a signal threshold level mode, or above or below said present maximum and minimum present values, respectively, if in boundary mode.

2. A method of controlling operation of a centrifugal pump in a fluid pumping system having a variable frequency drive (VFD) powering an alternating current (AC) motor which turns said centrifugal pump, said method comprising:

internally monitoring automatically output current and voltage of the VFD to the AC motor without the need for an external sensor;

calculating automatically output power based on monitored values of said output current and voltage and not on torque or speed of the AC motor;

checking automatically whether said calculated output power is above a predetermined high power limit for a desired setpoint;

checking automatically whether said calculated output power is below a predetermined low power limit for said desired setpoint, wherein said high and low power limits are fixed values;

receiving feedback from an external process sensor, wherein said feedback is indicative of said desired setpoint;

initiating automatically a first predetermined response action if said calculated output power is either above said predetermined high power limit or below said predetermined low power limit;

wherein said high power limit is set to lowest of either power at the end of a performance curve of the pump, maximum rated motor power, or power rating of magnetic coupling of a magnetic drive pump or a canned motor pump, and wherein said low power limit is set for the highest of the performance curve of the pump or power required at minimum continuous recommended flow;

using a high power level delay which is a time period that the output power must exceed the high power limit before said predetermined response action is initiated;

monitoring an externally provided analog sensor signal;

and initiating automatically a second predetermined response action if in a signal threshold level mode said analog sensor signal crosses one or both preset levels in the same direction, wherein each of said preset levels can initiate a separate response, or if in boundary mode, said analog sensor signal rising above a preset maximum value or drops below a preset minimum value, and in both modes, if after expiration of a time delay said analog sensor signal is still above one or both said preset levels if in a signal threshold level mode, or above or below said present maximum and minimum present values, respectively, if in boundary mode.

3. The method of claim 1 wherein said method further comprises automatically adjusting said high and low power limits using pump Affinity Law calculations for a current pump operating speed.

4. The method of claim 1 wherein said method further comprises automatically calculating said high and low power limits initially using said pump Affinity Law calculations and a predetermined pump speed, and automatically adjusting said high and low power limits using said pump Affinity Law calculations for a current pump operating speed detected by said external process sensor.

5. The method of claim 1 further comprising using a motor efficiency factor with said calculated output power to provide a better estimation of actual motor power to the pump.

6. The method of claim 1 further comprising using an automatic start time delay to allow the pump to attain normal operations during startup and to prevent fluctuations in said output power during the startup from triggering said first predetermined response action, wherein said high and low power limits are disabled during the time period of said automatic start time delay.

7. The method of claim 1 further comprising using an automatic retry to attempt to re-establish normal operations after triggering said first predetermined response action and a preset retry time delay, wherein the number of retries of said automatic retry is adjustable.

8. The method of claim 1 further comprising using a low power level delay which is a time period that the output power must be below the low power limit before said first predetermined response action is initiated.

9. The method of claim 1 further comprising:

using an automatic retry to attempt to re-establish normal operations after triggering said first predetermined response action and a preset retry time delay, wherein the number of retries of said automatic retry is adjustable;

and aborting said automatic retry process if said number of retries is set to zero or number of tries is exhausted.

10. The method of claim 1 further comprising using said method to detect operating conditions that are harmful to at least one of the pump and the process, the operating condition selected from the group consisting of dry running, low flow, changes in pumped fluid characteristics, blocked lines, blocked filters, blocked heat exchangers, uncoupled pump, closed suction or discharge valves, overload conditions, excessive wear, or rubbing.

11. The method of claim 1 wherein said first predetermined response action is to activate a digital output relay to initiate other user defined actions.

12. The method of claim 1, wherein said first predetermined response action is to activate a digital output relay to initiate other user defined actions selected from a condition annunciation using an external signaling device, a condition signaling to an external controller, and energizing other equipment.

13. The method of claim 7 wherein said first predetermined response action is to activate the automatic retry.

14. The method of claim 1, wherein said first predetermined response action is selected from message only, pump shutdown, speed override in which said desired setpoint is changed to an alternate programmable preset speed setpoint, and process override in which said desired setpoint is changed to an alternate programmable preset process setpoint.

15. The method of claim 1 further comprising:

entering into data a maximum pump speed that the pump should run in the fluid pump system;

entering into data a minimum pump speed that the pump should run in the fluid pump system;

entering into data a positive threshold percentage that a process variable being monitored must remain within from a desired process variable setpoint;

entering a negative threshold percentage that the process variable being monitored must remain within from the desired process variable setpoint;

monitoring the pump speed using an internally estimated pump speed parameter and the process variable with said external process sensor;

checking automatically whether said process variable is within a range defined by said positive and negative threshold percentages about said process variable setpoint;

and initiating automatically the second predetermined response action either if said process variable is outside said range after expiration of a time period or if said process variable is not attained within said maximum and minimum speeds.

16. The method of claim 15, wherein said process variable is selected from flow, temperature, pressure, and level.

17. The method of claim 15, wherein said second predetermined response action is selected from message only, pump shutdown, speed override in which said desired process variable setpoint is changed to an alternate programmable preset speed setpoint, and process override in which said desired process variable setpoint is changed to an alternate programmable preset process variable setpoint.

18. The method of claim 15 further comprising using said method to detect a change in process fluid or system characteristics, loss of adequate suction, or equipment failure or wear.

19. The method of claim 1, wherein said second predetermined response action is selected from message only, pump shutdown, speed override in which a predetermined setpoint is changed to an alternate programmable preset speed setpoint, and process override in which said predetermined setpoint is changed to an alternate programmable preset process variable setpoint.

20. The method of claim 1 further comprising:

monitoring a state condition of a digital input;

and initiating automatically a third predetermined response action upon detection of a change in said state condition of said digital input and after expiration of a time delay said state condition does not further change.

21. The method of claim 20, wherein third predetermined response action is selected from message only, pump shutdown, speed override in which a predetermined setpoint is changed to an alternate programmable preset speed setpoint, and process override in which said predetermined setpoint is changed to an alternate programmable preset process variable setpoint.

22. The method of claim 20 wherein said state condition is either ON and OFF states of the digital input.

23. The method of claim 20 wherein said digital input is from a switching devices selected from a limit switch, a level switch, a pressure switch, a temperature switch, a flow switch, and a relay contact.

24. The method of claim 1 further comprising adjusting automatically the desired setpoint in response to the sensor signal based on a programmable multi-point scaling table that determines a multiplier value that is applied to the desired setpoint.

25. The method of claim 24 wherein said multi-point scaling table consists of a plurality of value pairs, wherein each value pair contains an input signal percentage that ranges from 0% to 100% and an output scaler percentage ranges from 0% to 150%, wherein said sensor signal is compared to the input signal percentage values in the scaling table, and wherein the output scaler percentage in the corresponding value pair matching the input signal percentage becomes the setpoint multiplier value.

26. The method of claim 25 further comprising using interpolation to calculate the setpoint multiplier value that fall between value pairs in the scaling table.

27. The method of claim 24 further comprising using said method in an application to empty a vessel to slow down the pump according to the pair values defined in the scaling table, wherein a suction pressure sensor provides the analog sensor signal to indicate level in the vessel being emptied.

28. A controller comprising a non-transitory computer readable medium comprising instructions implementing the method of claim 1.

29. A controller comprising a non-transitory computer readable medium comprising instructions implementing the method of claim 1 and provided integral with the VFD.

30. A controller comprising a non-transitory computer readable medium comprising instructions implementing the method of claim 15.

31. A controller comprising a non-transitory computer readable medium comprising instructions implementing the method of claim 15 and provided integral with the VFD.

32. A controller comprising a non-transitory computer readable medium comprising instructions implementing the method of claim 2.

33. A controller comprising a non-transitory computer readable medium comprising instructions implementing the method of claim 2 and provided integral with the VFD.

34. A controller comprising a non-transitory computer readable medium comprising instructions implementing the method of claim 20.

35. A controller comprising a non-transitory computer readable medium comprising instructions implementing the method of claim 20 and provided integral with the VFD.

36. A controller comprising a non-transitory computer readable medium comprising instructions implementing the method of claim 24.

37. A controller comprising a non-transitory computer readable medium comprising instructions implementing the method of claim 24 and provided integral with the VFD.

* * * * *

UNITED STATES PATENT AND TRADEMARK OFFICE

CERTIFICATE OF CORRECTION

PATENT NO. : 8,774,972 B2
APPLICATION NO. : 11/748126
DATED : July 8, 2014
INVENTOR(S) : Dennis M. Rusnak et al.

It is certified that error appears in the above-identified patent and that said Letters Patent is hereby corrected as shown below:

In the Specification

Col. 2, Line 65,
"any type of VFD devices. It is still other embodiments. VFDs" should read
--any type of VFD devices. In still other embodiments, VFDs--;

Col. 3, Line 3,
"which to modified with at least the executable software 80 of" should read
--which to be modified with at least the executable software 80 of--;

Col. 3, Line 38,
"will now be explained in greater details with refer made also" should read
--will now be explained in greater details with reference made also--;

Col. 3, Line 65,
"controller 30 also include a number of other analog inputs 152" should read
--controller 30 also includes a number of other analog inputs 152--;

Col. 3, Line 66,
"and analog outputs 154 as well as the a number of digital" should read
--and analog outputs 154 as well as a number of digital--;

Col. 6, Line 9,
"ignated herein as Analog Input n. In the follow example," should read
--ignated herein as Analog Input n. In the following example,--;

Col. 7, Line 21,
"An internal proportional integral control algorithms (PI" should read
--An internal proportional integral control algorithm (PI--;

Signed and Sealed this
Twenty-first Day of April, 2015

Michelle K. Lee

Michelle K. Lee
*Director of the United States Patent and Trademark Office*

Col. 7, Line 42,
"bility will remain). The error can, however, is reduced to zero" should read
--bility will remain). The error, however, is reduced to zero--;

Col. 8, Line 24,
"ence, and analog input. In the follow example, analog input is" should read
--ence, and analog input. In the following example, analog input is--;

Col. 8, Line 26,
"input designated as Analog Input x is ether Analog Input m or" should read
--input designated as Analog Input x is either Analog Input m or--;

Col. 8, Line 30,
"voltage sensor (AINx TYPE). In step 558, the user enter the" should read
--voltage sensor (AINx TYPE). In step 558, the user enters the--;

Col. 9, Line 43,
"fixed power loses taking into account. Also, The present" should read
--fixed power losses taken into account. Also, the present--;

Col. 12, Line 27,
"VFD's typically incorporate equipment protection tech-" should read
--VFDs typically incorporate equipment protection tech- --;

TABLE 2, Lines 4 and 5,
"3) "PVM Hi Warn" - Maximum speed and setpoint is not attained
4) "PVM Lo Warn" - Minimum speed and setpoint is not attained" should read
--1) "PVM Hi Warn" - Maximum speed and setpoint is not attained
2) "PVM Lo Warn" - Minimum speed and setpoint is not attained--;

TABLE 2, Line 15,
"1) "PVM Hi SpdOv" - Status message displayed if the max spped condition is initiated" should read
--1) "PVM Hi SpdOv" - Status message displayed if the max speed condition is initiated--;

Col. 15, Line 55,
"analog input. Since these steps are same as steps 506-514" should read
--analog Input. Since these steps are the same as steps 506-514--;

Col. 16, Line 25,
"In step 814, the user selects either "Boundary mode or" should read
--In step 814, the user selects either "Boundary" mode or--;

Col. 16, Line 46,
"PCM response action to be initiated" should read
--PCM response action is to be initiated--;

Col. 16, Line 47,
"In step 820, the users enters the maximum time that the" should read
--In step 820, the user enters the maximum time that the--;

TABLE 3, Line 64,
"2) PCM Lo Warn" -- Status message is displayed if "Level 1" (Level) is exceeded of if the" should read
--2) PCM Lo Warn" -- Status message is displayed if "Level 1" (Level) is exceeded or if the--;

TABLE 3, Line 9,
"Speed Override Control mode changes to Speed mode. The speed setpoint is change to an alternate" should read
--Speed Override Control mode changes to Speed mode. The speed setpoint is changed to an alternate--;

TABLE 3, Line 16,
"Process Override Valid only in Process Mode. The process setpoint is change to an alternate programmable" should read
--Process Override Valid only in Process Mode. The process setpoint is changed to an alternate programmable--;

Col. 18, Lines 35-36,
"user set the operation of the DIM (INVERT DIMN OPERATION) The user selects "No" for normal operation (high" should read
--user sets the operation of the DIM (INVERT DIMN OPERATION). The user selects "No" for normal operation (high--;

Col. 18, Line 40,
"able response are listed in Table 4 below." should read
--able responses are listed in Table 4 below.--;

TABLE 4, Line 54,
"Speed Override Control mode changes to Speed mode. The speed setpoint is change to an alternate" should read
--Speed Override Control mode changes to Speed mode. The speed setpoint is changed to an alternate--;

TABLE 4, Line 61,
"Process Override Valid only in Process Mode. The process setpoint is change to an alternate programmable" should read
--Process Override Valid only in Process Mode. The process setpoint is changed to an alternate programmable--;

Col. 19, Line 53,
"these step are same as steps 506-514 performed during the" should read
--these steps are the same as steps 506-514 performed during the--;

Col. 19, Line 63-64,
"percent (%) values range from 0% to 100% of the ten input signal (MPS INPUTn(n=1 to 10)) and are the values that are" should read
--percent (%) values ranging from 0% to 100% of the ten input signals (MPS INPUTn(n=1 to 10)) and are the values that are--;

Col. 20, Line 12,
"PUTn(n=1 to 10)) can ranges from 0% to 150%. These values" should read
--PUTn(n=1 to 10)) can range from 0% to 150%. These values--;

Col. 21, Line 41,
"ing an additional pump), and the likes." should read
--ing an additional pump), and the like.--;

In the Claims

Col. 22, Line 32, Claim 1,
"desired setpoint," should read
--desired setpoint;--; and Col. 25, Line 37, Claim 23,
"from a switching devices selected from a limit switch, a level" should read
--from a switching device selected from a limit switch, a level--.